US009873984B2

(12) United States Patent
Kawagoe et al.

(10) Patent No.: US 9,873,984 B2
(45) Date of Patent: Jan. 23, 2018

(54) COMPOSITE PAPER HAVING OIL RESISTANCE

(71) Applicant: KURARAY CO., LTD., Kurashiki-shi (JP)

(72) Inventors: Masako Kawagoe, Kurashiki (JP); Yosuke Kumaki, Kurashiki (JP)

(73) Assignee: KURARAY CO., LTD., Kurashiki-shi (JP)

( * ) Notice: Subject to any disclaimer, the term of this patent is extended or adjusted under 35 U.S.C. 154(b) by 172 days.

(21) Appl. No.: 14/894,797

(22) PCT Filed: May 30, 2014

(86) PCT No.: PCT/JP2014/064477

§ 371 (c)(1),
(2) Date: Nov. 30, 2015

(87) PCT Pub. No.: WO2014/192931

PCT Pub. Date: Dec. 4, 2014

(65) Prior Publication Data

US 2016/0130763 A1 May 12, 2016

(30) Foreign Application Priority Data

May 31, 2013 (JP) ..... 2013-114930
Jul. 19, 2013 (JP) ..... 2013-150178

(51) Int. Cl.

| | |
|---|---|
| ***D21H 19/00*** | (2006.01) |
| ***D21H 19/38*** | (2006.01) |
| ***D21H 19/40*** | (2006.01) |
| ***D21H 19/60*** | (2006.01) |
| ***D21H 19/76*** | (2006.01) |
| ***C08F 210/02*** | (2006.01) |
| ***C08F 216/06*** | (2006.01) |
| ***D21H 19/12*** | (2006.01) |
| ***D21H 19/20*** | (2006.01) |
| ***D21H 21/16*** | (2006.01) |
| ***D21H 27/10*** | (2006.01) |
| ***D21H 19/22*** | (2006.01) |

(52) U.S. Cl.

CPC ..... *D21H 19/12* (2013.01); *D21H 19/00* (2013.01); *D21H 19/20* (2013.01); *D21H 19/22* (2013.01); *D21H 19/38* (2013.01); *D21H 19/40* (2013.01); *D21H 19/60* (2013.01); *D21H 19/76* (2013.01); *D21H 21/16* (2013.01); *D21H 27/10* (2013.01)

(58) Field of Classification Search

CPC ..... D21H 19/00–19/84
USPC ..... 428/511, 515
See application file for complete search history.

(56) References Cited

U.S. PATENT DOCUMENTS

| | | | | |
|---|---|---|---|---|
| 6,472,470 | B1 | 10/2002 | Fujiwara et al. | |
| 2004/0241475 | A1 | 12/2004 | Morabito | |
| 2007/0087190 | A1 | 4/2007 | Akiyama et al. | |
| 2008/0268240 | A1 | 10/2008 | Akiyama | |
| 2012/0128956 | A1* | 5/2012 | Takatsu ..... | C08J 7/045 428/216 |

FOREIGN PATENT DOCUMENTS

| | | | |
|---|---|---|---|
| EP | 0 867 562 | A1 | 9/1998 |
| JP | 11-323781 | A | 11/1999 |
| JP | 2000-309607 | A | 11/2000 |
| JP | 2001-214396 | A | 8/2001 |
| JP | 2004-68180 | A | 3/2004 |
| JP | 4142148 | B2 | 8/2008 |
| JP | 2010-275647 | A | 12/2010 |
| JP | 2010-275647 | A | 12/2010 |
| WO | 2006/085572 | A1 | 8/2006 |

OTHER PUBLICATIONS

Machine translation of JP 2004-068180, Mar. 2004.*
Extended European Search Report dated Dec. 8, 2016 in Patent Application No. 14805154.3.
International Search Report dated Sep. 2, 2014 in PCT/JP2014/064477 filed May 30, 2014.

* cited by examiner

*Primary Examiner* — Ramsey E Zacharia
(74) *Attorney, Agent, or Firm* — Oblon, McClelland, Maier & Neustadt, L.L.P.

(57) ABSTRACT

The present invention addresses the problem of providing a composite paper which exhibits excellent oil resistance, water vapor permeability, and water resistance even when hot and oily food is wrapped therein. The above problem can be solved by using a composite paper comprising an oil-resistant layer formed on at least one surface of a base paper, wherein the oil-resistant layer comprises a vinyl alcohol polymer (A) having a content of ethylene units of 2 to 10 mol %, a viscosity-average degree of polymerization of 300 to 2000, a saponification degree of 95 to 99.5 mol %, a total content of carboxyl groups and lactone rings of 0.02 to 3 mol %, a melting point of 180 to 230° C., a content of 1,2-glycol bonds of 1.2 to 2 mol %, and a molar fraction of central hydroxyl groups in chains of three consecutive hydroxyls by a triad expression relative to vinyl alcohol units of 65 to 98 mol %, the base paper has an air permeability resistance of 1000 seconds or less and a bulk density of 0.5 to 1.0 g/cm$^3$, and the oil-resistant layer is formed in an amount of 0.1 to 10.0 g/m$^2$ in terms of dry mass. The oil-resistant layer may also contain a fluorine compound (B), a layered inorganic compound (C) having an average aspect ratio of 20 to 1000, a fatty acid sizing agent (D), or a cross-linking agent (E).

11 Claims, No Drawings

COMPOSITE PAPER HAVING OIL RESISTANCE

TECHNICAL FIELD

The present invention relates to a composite paper comprising an oil-resistant layer comprising a vinyl alcohol polymer, which exhibits excellent oil resistance, water vapor permeability and water resistance even when it wraps a hot and oily food.

BACKGROUND ART

A greaseproof paper is defined as "1) a collective designation of a paper having oil resistance. 2) a paper or board which is extremely resistant to permeation of grease or fats." in JIS P0001 "Paper, board and pulp-Vocabulary".

Greaseproof papers having oil-resistant have been extensively used as a wrapping material for foods. In particular, a greaseproof paper is used for food containing much oils or fat components such as a chocolate, a pizza and a doughnut, preventing the oil from permeating a wrapping material. If oils and/or fat components contained in a food permeate a wrapping material, the oily components permeate to a surface with which the food is not in contact, resulting in grease stain which may lead to deteriorated appearance and thus a reduced commercial value, blackening of a printed part which makes it difficult to read letters, deterioration in OCR suitability of a bar code or the like, and so on. Furthermore, the oils may be transferred to fingers or cloths, leading to smear. Thus, a greaseproof paper endowed with oil resistance is used in a part with which a food is in contact.

Fluorine compounds, particularly perfluoro compounds have been used as an oilproof agent for endowing a greaseproof paper with oil resistance. However, a processed paper containing a fluorine compound repels even a print ink due to its high oil-repellence, so that it causes a void in a solid printing area in gravure printing.

Furthermore, during combustion, a fluorine compound having a perfluoroalkyl group generates toxic hydrogen fluoride. Moreover, recently, it has been demonstrated that perfluorooctanesulfonates generated through an electropolymerization process for producing a fluorine compound are extensively accumulated in human or animal blood and the environment such as seawater, and that when being heated at 100° C. or higher, a fluorine compound produced by an electropolymerization or telomerization process, irrespective of a producing method, gives a perfluoroalcohol which is highly environmentally accumulative and other low-molecular-weight fluorine compounds are also generally persistent. Therefore, particularly in food-wrapping applications, it is desired to realize high oil resistance without using a fluorine compound. Therefore, a greaseproof paper in which a paper substrate is coated with a non-fluorine oilproof agent in place of a fluorine compound has been proposed.

It is known that a vinyl alcohol polymer (hereinafter, "vinyl alcohol polymer" is sometimes referred to as "PVA") can be used as a non-fluorine oilproof agent. PVA is a hydrophilic resin and forms a robust film, so that it prevents oil permeation and exhibits good oil resistance. For example, Patent Reference No. 1 has proposed a greaseproof paper coated with a coating material containing a PVA or a combination of a PVA with a cross-linking agent, and Patent Reference No. 2 has proposed a greaseproof paper coated with a coating agent containing starch and/or a PVA and a fatty acid. For both cases, particularly when a hot and oily food is wrapped, that is, under high-temperature conditions, oil resistance is insufficient. In particular, when a low-density base paper with an air permeability resistance of 1000 sec or less is used, this problem is significant. When a PVA content in a coating liquid is increased for improving oil resistance, water vapor permeability is reduced. Furthermore, since a PVA is a water-soluble polymer, water absorbability may be increased. Thus, when a fried food such as tempura and fried chicken, or a steamed bun such as Chinese bun which is hot by steaming is wrapped, or when it is heated by a moisturing apparatus or a microwave, the inside of the package is filled with steam emitted from the food, so that a batter coating of a fry or the like absorbs moisture to be excessively soft, taste is impaired, or the paper surface becomes sticky.

Thus, for improving liquid shielding and water resistance, Patent Reference No. 3 has proposed a composite paper having a layer of a resin composition containing a saponified ethylene-vinyl acetate copolymer and a layered inorganic compound. Its oil resistance under high temperature conditions is, however, insufficient.

PRIOR ART REFERENCES

Patent References

Patent Reference No. 1: JP 2004-68180A
Patent Reference No. 2: WO 2006085572A1
Patent Reference No. 3: JP 2001-214396A

SUMMARY OF THE INVENTION

Problem to be Solved by the Invention

An objective of the present invention is to provide a composite paper exhibiting excellent oil resistance even when it wraps a hot and oily food and exhibiting excellent water vapor permeability and water resistance even when it wraps a steamy food.

Means for Solving Problem

As a result of intensive investigation, we have found that an oil-resistant layer comprising a particular vinyl alcohol polymer (A) is formed on at least one surface of a base paper with an air permeability resistance of 1000 seconds or less and a bulk density of 0.5 to 1.0 g/cm$^3$ or less in an amount of 0.1 to 10.0 g/m$^2$ in terms of dry mass to provide a paper exhibiting excellent oil resistance even when it wraps a hot and oily food and exhibiting excellent water vapor permeability and water resistance even when it wraps a steamy food.

Specifically, the present invention relates to the followings.

[1] A composite paper comprising an oil-resistant layer formed on at least one surface of a base paper, wherein the oil-resistant layer comprises a vinyl alcohol polymer (A) having a content of ethylene units of 2 to 10 mol %, a viscosity-average degree of polymerization of 300 to 2000, a saponification degree of 95 to 99.5 mol %, a total content of carboxyl groups and lactone rings of 0.02 to 3.0 mol %, a melting point of 180 to 230° C., a content of 1,2-glycol bonds of 1.2 to 2 mol %, and a molar fraction of central hydroxyl groups in chains of three consecutive hydroxyls by a triad expression relative to vinyl alcohol units of 65 to 98 mol %, the base paper has an air permeability resistance of 1000 seconds or less and a bulk density of 0.5 to 1.0 g/cm$^3$, and the oil-resistant layer is formed in an amount of 0.1 to 10.0 g/m$^2$ in terms of dry mass.

[2] The composite paper as described in [1], with a water vapor transmission rate of 1000 g/m$^2$·24 h or more.

[3] The composite paper as described in [1] or [2], wherein the oil-resistant layer comprising the vinyl alcohol polymer (A) further comprises 1 to 50 parts by mass of a fluorine compound (B) based on 100 parts by mass of the vinyl alcohol polymer (A), and the oil-resistant layer is formed in an amount of 0.1 to 3.0 g/m$^2$ in terms of dry mass.

[4] The composite paper as described in [1], further comprising 10 to 200 parts by mass of a layered inorganic compound (C) with an average aspect ratio of 20 to 1000 based on 100 parts by mass of the vinyl alcohol polymer (A), wherein the oil-resistant layer is formed on at least one surface of a base paper having an permeability resistance of 1000 sec or less and a bulk density of 0.5 to 1.0 g/cm$^3$, in an amount of 1.0 to 10.0 g/m$^2$ in terms of dry mass.

[5] The composite paper as described in [4], wherein the layered inorganic compound is kaolin.

[6] The composite paper as described in [4], wherein the layered inorganic compound is talc.

[7] The composite paper as described in [4], wherein the layered inorganic compound is a swelling clay mineral.

[8] The composite paper as described in any of [4] to [7], further comprising 50 parts or less of a fatty acid sizing agent (D) based on 100 parts by mass of the vinyl alcohol polymer (A).

[9] The composite paper as described in any of [1] to [8], further comprising 30 parts by mass or less of a cross-linking agent (E) based on 100 parts by mass of the vinyl alcohol polymer (A).

[10] The composite paper as described in [9], wherein the cross-linking agent (E) is a polyamide epichlorohydrin compound.

[11] The composite paper as described in [9], wherein the cross-linking agent (E) is a zirconium compound.

[12] The composite paper as described in [11], wherein the cross-linking agent (E) is zirconium oxynitrate.

Effects of the Invention

A composite paper of the present invention can maintain oil resistance to such an extent that no practical problems are caused even when it wraps a hot and oily food and is furthermore excellent in water vapor permeability and water resistance. It is, therefore, useful for providing a practicable greaseproof paper for a package, container or the like not only for various fried foods and fat-containing foods, but also steamy foods.

Modes for Carrying Out the Invention

The present invention will be described in detail.

A vinyl alcohol polymer (A) used in the present invention essentially has ethylene units. A content of the ethylene units is essentially 2 to 10 mol %, preferably 2.5 to 9.5 mol %, further preferably 3 to 9 mol %, particularly preferably 3.5 to 8.5 mol %. If a content of the ethylene units is less than 2 mol %, a composite paper obtained may have significantly reduced oil resistance or water resistance under high-temperature conditions. If a content of the ethylene units is more than 10 mol %, a vinyl alcohol polymer may be insoluble in water, leading to difficulty in forming uniform coating on a base paper.

A content of the ethylene units in the vinyl alcohol polymer (A) can be, for example, determined from a proton NMR spectrum of a polyvinyl ester containing ethylene units which is a precursor or re-acetylated product of the vinyl alcohol polymer. Specifically, a polyvinyl ester obtained is purified by reprecipitation in n-hexane/acetone three times, and dried under a reduced pressure at 80° C. for 3 days to prepare a polyvinyl ester for analysis. The polymer is dissolved in DMSO-$D_6$, and was subjected to proton NMR (for example, 500 MHz) at 80° C. Using peaks derived from main-chain methines of the vinyl ester (4.7 to 5.2 ppm) and peaks derived from ethylene, the vinyl ester and main-chain methylene of the third component (0.8 to 1.6 ppm), a content of the ethylene units can be calculated.

A viscosity-average degree of polymerization (hereinafter, abbreviated as "polymerization degree") of the vinyl alcohol polymer (A) is essentially 300 to 2000. The polymerization degree is preferably 320 to 1800, further preferably 340 to 1600, particularly preferably 350 to 1500. If the polymerization degree is less than 300, formation of a film of the vinyl alcohol polymer is difficult, so that a composite paper produced may have insufficient oil resistance. If the polymerization degree is more than 2000, the aqueous solution is so viscous that coating suitability to a base paper may be deteriorated, resulting in tendency to uneven coating and thus insufficient performance. A polymerization degree (P) of a PVA polymer is determined in accordance with JIS-K6726. Specifically, a PVA polymer is re-saponified, purified, and subjected to measurement of a intrinsic viscosity [η](l/g) in water at 30° C., from which a polymerization degree is determined from the following equation.

$$P=([\eta]\times10^4/8.29)^{(1/0.62)}$$

A saponification degree of the vinyl alcohol polymer (A) is essentially 95 to 99.5 mol %. The saponification degree is preferably 96 to 99.3 mol %, more preferably 97 to 99.1 mol %, particularly preferably 97.5 to 99.0 mol %. If the saponification degree is less than 95 mol %, a composite paper obtained may have insufficient water resistance. If the saponification degree is more than 99.5 mol %, problems such as rapid increase of viscosity during storage of the aqueous solution and precipitation of a filamentous substance during coating may be caused, resulting in difficulty in stably producing a composite paper.

A total content of carboxyl groups and lactone rings of the vinyl alcohol polymer (A) is essentially 0.02 to 3.0 mol % based on a molar number of the whole monomer units. The total content of carboxyl groups and lactone rings is preferably 0.025 to 2.5 mol %, more preferably 0.03 to 2.25 mol %, particularly preferably 0.05 to 2.0 mol %. If the total content of carboxyl groups and lactone rings is less than 0.02 mol %, a composite paper obtained may have insufficient oil resistance, and dispersibility is reduced when it is combined with a layered inorganic compound. If the total content of carboxyl groups and lactone rings is more than 3.0 mol %, water resistance of a composite paper obtained may be reduced. A carboxyl group in the present invention includes its alkali-metal salts, and examples of such an alkali metal include potassium and sodium.

A vinyl alcohol polymer having ethylene units in a particular amount and having carboxyl group or lactone ring can be produced by, for example, any of the following processes.

i) A vinyl ester polymer produced by copolymerizing a vinyl ester monomer such as vinyl acetate with a monomer capable of generating carboxyl groups or lactone rings is saponified in an alcohol or dimethylsulfoxide solution.

ii) In the presence of a carboxyl-containing thiol compound such as mercaptoacetic acid and 3-mercaptopropionic acid, a vinyl ester monomer is polymerized and then saponified.

iii) While a vinyl ester monomer such as vinyl acetate is polymerized, a chain transfer reaction to vinyl ester monomer and an alkyl group in a vinyl ester polymer is initiated to provide a hyperbranched vinyl ester polymer, which is then saponified.

iv) A copolymer of an epoxy-containing monomer with a vinyl ester monomer is reacted with a thiol compound having a carboxyl group and the product is saponified.

v) A PVA is acetalized with an aldehyde having a carboxyl group.

Examples of a vinyl ester monomer include vinyl formate, vinyl acetate, vinyl propionate, vinyl valerate, vinyl caprate, vinyl laurate, vinyl stearate, vinyl benzoate, vinyl pivalate and vinyl versatate. Among these, vinyl acetate is preferable in the light of producing a PVA. Examples of a monomer capable of generating carboxyl groups or lactone rings include a monomer having a carboxyl group derived from fumalic acid, maleic acid, itaconic acid, maleic anhydride, itaconic anhydride or the like; acrylic acid and salts thereof; acrylic acid esters such as methyl acrylate, ethyl acrylate, n-propyl acrylate and i-propyl acrylate; methacrylic acid and salts thereof; methacrylic acid esters such as methyl methacrylate, ethyl methacrylate, n-propyl methacrylate and i-propyl methacrylate; acrylamide derivatives such as acrylamide, N-methylacrylamide and N-ethylacrylamide; and methacrylamide derivatives such as methacrylamide, N-methylmethacrylamide and N-ethylmethacrylamide. A carboxyl group introduced through copolymerization easily reacts with a hydroxyl group in an adjacent vinyl alcohol unit to form a lactone ring, and it more easily takes place particularly when a ring to be formed is a five-membered ring.

A total content of carboxyl groups and lactone rings in a vinyl alcohol polymer can be determined, for example, from peaks in a proton NMR spectrum. A vinyl alcohol polymer is saponified to a saponification degree of 99.95 mol % or more, thoroughly washed with methanol, and then dried in vacuo at 90° C. for 2 days to prepare a vinyl alcohol polymer for analysis. In the case of i), a prepared vinyl alcohol polymer for analysis is dissolved in DMSO-$D_6$ followed by proton NMR analysis at 60° C. A content is calculated as usual, using peaks derived from main-chain methines (2.0 ppm) for monomers of acrylic acid, an acrylic acid ester, acrylamide and an acrylamide derivative, and peaks derived from methyls directly attached to a main chain (0.6 to 1.1 ppm) for monomers of methacrylic acid, a methacrylic acid ester, methacrylamide and a methacrylamide derivative. For monomers having a carboxyl group derived from fumalic acid, maleic acid, itaconic acid, maleic anhydride, itaconic anhydride or the like, a prepared PVA for analysis is dissolved in DMSO-$D_6$ followed by adding several drops of trifluoroacetic acid, and is then subjected to proton NMR analysis at 60° C. For quantification, a content is calculated as usual, using peaks derived from methines in a lactone rings which are attributed to 4.6 to 5.2 ppm. For ii) and iv), a content is calculated using peaks derived from methylenes attached to a sulfur atom (2.8 ppm). For iii), a prepared PVA for analysis is dissolved in methanol-$D_4$/$D_2O$=2/8 and subjected to proton NMR analysis at 80° C. Peaks derived from methylenes terminal carboxyl groups or alkali metal salts thereof are attributed to 2.2 ppm (integral value A) and 2.3 ppm (integral value B), and peaks derived from methylenes in terminal lactone rings are attributed to 2.6 ppm (integral value C), and peaks derived from methines in vinyl alcohol units are attributed to 3.5 to 4.15 ppm (integral value D). Then, a content of carboxyl groups and lactone rings is calculated from the following equation, where Δ represents a modified amount (mol %).

$$\text{Content of carboxyl groups and lactone ring (mol \%)}=50(A+B+C)\times(100-\Delta)/(100\times D)$$

For v), a prepared PVA for analysis is dissolved in DMSO-$D_6$ and subjected to proton NMR analysis at 60° C. Using peaks derived from methines in acetal units at 4.8 to 5.2 ppm, a content is calculated as usual.

A vinyl alcohol polymer (A) can contain monomer units other than vinyl alcohol units, ethylene units, vinyl ester units and monomers capable of generating carboxyl groups or lactone rings described above, as long as they do not deteriorate the effects of the present invention. Examples of such a unit include α-olefins such as propylene, 1-butene, isobutene and 1-hexene; vinyl ethers such as methyl vinyl ether, ethyl vinyl ether, n-propyl vinyl ether, i-propyl vinyl ether and n-butyl vinyl ether; hydroxy-containing vinyl ethers such as ethyleneglycol vinyl ether, 1,3-propanediol vinyl ether and 1,4-butanediol vinyl ether; allyl ethers such as allyl acetate, propyl allyl ether, butyl allyl ether and hexyl allyl ether; oxyalkylene-containing monomers; vinylsilanes such as trimethoxysilane; hydroxy-containing α-olefins such as isopropenyl acetate, 3-buten-1-ol, 4-penten-1-ol, 5-hexen-1-ol, 7-octen-1-ol, 9-decen-1-ol and 3-methyl-3-buten-1-ol; sulfonic-containing monomers derived from ethylenesulfonic acid, allylsulfonic acid, methallylsulfonic acid and 2-acrylamide-2-methylpropanesulfonic acid; and monomers containing a cationic group such as vinyloxyethyl trimethylammonium chloride, vinyloxybutyl trimethylammonium chloride, vinyloxyethyl dimethylamine, vinyloxymethyl diethylamine, N-acrylamidemethyl trimethylammonium chloride, 3-(N-methacrylamide)propyl trimethylammonium chloride, N-acrylamideethyl trimethylammonium chloride, N-acrylamidedimethylamine, allyltrimethylammonium chloride, methallyl trimethylammonium chloride, dimethylallylamine, allylethylamine or the like. A content of these monomers is generally 20 mol % or less, preferably 10 mol % or less, although it varies, depending on an intended use or application.

A vinyl alcohol polymer (A) can be one terminally modified with a hydroxy group or a long-chain alkyl group which is prepared by copolymerizing a vinyl ester monomer such as vinyl acetate with ethylene in the presence of a thiol compound other than mercaptans having a carboxyl group described above, such as 2-mercaptoethanol, n-octylmercaptan and n-dodecylmercaptan followed by saponification.

A vinyl ester monomer can be copolymerized with ethylene by a well-known method such as bulk polymerization, solution polymerization, suspension polymerization and emulsion polymerization. Among these, bulk polymerization or solution polymerization in which polymerization proceeds in a neat system or in a solvent such as an alcohol is generally employed. Examples of an alcohol used as a solvent for solution polymerization include lower alcohols such as methyl alcohol, ethyl alcohol and propyl alcohol. An initiator used for the copolymerization can be selected from known initiators such as azo initiators and peroxide initiators including 2,2'-azobisisobutyronitrile, 2,2'-azobis(2,4-dimethyl-valeronitrile), benzoyl peroxide and n-propyl peroxydicarbonate. There are no particular restrictions to a polymerization temperature, but it is appropriately within a range of 0° C. to 150° C. However, for selecting the polymerization conditions, a variety of conditions must be properly set in order to provide a desired vinyl alcohol polymer of the present invention as described in Examples below.

A melting point of the vinyl alcohol polymer (A) is essentially 180 to 230° C. The melting point is preferably 190 to 225° C., further preferably 200 to 220° C. If the melting point is less than 180° C., crystallinity of a vinyl alcohol polymer becomes so low that a composite paper obtained may have insufficient oil resistance or water resistance. If the melting point is higher than 230° C., crystallinity may be so high that viscosity of a prepared aqueous solution may be unstable, leading to difficulty in coating it on a base paper.

A melting point of a vinyl alcohol polymer means a peak top temperature of an endothermic peak indicating a melting point of the vinyl alcohol polymer after it is heated to 250° C. at a temperature rise rate of 10° C./min under nitrogen atmosphere, cooled to room temperature and then again heated to 250° C. at a temperature rise rate of 10° C./min by means of DSC.

A content of 1,2-glycol bonds in a vinyl alcohol polymer (A) is essentially 1.2 to 2 mol %. The content of 1,2-glycol bonds is preferably 1.25 to 1.95 mol %, more preferably 1.3 to 1.9 mol %. If the content of 1,2-glycol bonds in the vinyl alcohol polymer (A) is less than 1.2 mol %, crystallinity of the PVA may be so high that viscosity of the aqueous solution may be significantly unstable, leading to deterioration in coating suitability. If the content of 1,2-glycol bonds in the PVA is more than 2 mol %, crystallinity of the PVA may be so low that a composite paper may have insufficient oil resistance or water resistance.

A content of 1,2-glycol bonds in a vinyl alcohol polymer can be controlled, for example, by means of a polymerization temperature. A content of 1,2-glycol bonds in a PVA can be determined from peaks in a NMR spectrum. A PVA is saponified to a saponification degree of 99.9 mol % or more followed by thoroughly washing with methanol. The PVA is dried in vacuo at 90° C. for 2 days and dissolved in DMSO-$D_6$ followed by adding several drops of trifluoroacetic acid, and is then subjected to proton NMR analysis at 80° C. Peaks derived from methines in vinyl alcohol units are attributed to 3.2 to 4.0 ppm (integral value A'), and a peak derived from one methine in 1,2-glycol bonds is attributed to 3.25 ppm (integral value B'). Then, a content of 1,2-glycol bonds can be calculated from the following equation, where Δ represents an ethylene-modified amount (mol %).

$$\text{Content of 1,2-glycol bonds (mol \%)} = B'(100-\Delta)/A'$$

"Central hydroxyl groups in chains of three consecutive hydroxyls by a triad expression relative to vinyl alcohol units" means Peak (I) reflecting tacticity of a triad of hydroxyl methine protons as measured at 65° C. using proton NMR of a solution of PVA in DMSO-$D_6$. Furthermore, "central hydroxyl groups in chains of three consecutive hydroxyls" means hydroxyl groups of central vinyl alcohol units in chains of three consecutive hydroxyls. Peak (I) is represented as the sum of isotacticity chains (4.54 ppm), heterotacticity chains (4.36 ppm) and syndiotacticity chains (4.13 ppm) by a triad expression of PVA hydroxyls, and Peak (II) derived from hydroxyls in the total vinyl alcohol units appear within a chemical shift range of 4.05 ppm to 4.70 ppm. Therefore, a molar fraction of central hydroxyl groups in chains of three consecutive hydroxyls by a triad expression relative to vinyl alcohol units is expressed as 100×integral value of Peak (I)/integral value of Peak (II).

A content of central hydroxyl groups in chains of three consecutive hydroxyls by triad expression in the vinyl alcohol polymer (A) is essentially 65 to 98 mol %. A content of central hydroxyl groups in chains of three consecutive hydroxyls by triad expression is preferably 70 to 97.5 mol %, more preferably 72 to 97 mol %, further preferably 74 to 96 mol %, particularly preferably 75 to 95 mol %. If a content of central hydroxyl groups in chains of three consecutive hydroxyls by triad expression in a PVA is less than 65 mol %, crystallinity of the vinyl alcohol polymer becomes extremely low, so that high oil resistance or water resistance to be intended by the present invention cannot be achieved, and mechanical properties of a vinyl alcohol polymer are deteriorated in a composite paper. If a content of central hydroxyl groups in chains of three consecutive hydroxyls by triad expression in the PVA is more than 98 mol %, crystallinity of the polymer is extremely high, so that preparation of an aqueous solution of the PVA may be very troublesome and viscosity of the aqueous solution prepared may be too high to coat it on a base paper suitably.

A vinyl alcohol polymer (A) can be produced by a known method such as saponification of a vinyl ester polymer, which is obtained by copolymerizing ethylene with the above vinyl ester monomer, in an alcohol or dimethylsulfoxide solution.

Examples of an alkaline substance used as a saponification catalyst include potassium hydroxide and sodium hydroxide. A molar ratio of the alkaline substance used as a saponification catalyst is preferably 0.004 to 0.5, particularly preferably 0.005 to 0.1 based on vinyl acetate units. The saponification catalyst can be added in one portion at the initiation of the saponification reaction or additionally added in the course of the saponification reaction. Examples of a solvent for the saponification reaction include methanol, methyl acetate, dimethylsulfoxide and dimethylformamide. Among these solvents, methanol is preferable in the light of reactivity. A temperature of the saponification reaction is preferably 5 to 80° C., more preferably 20 to 70° C. A saponification time is preferably 5 min to 10 hours, more preferably 10 min to 5 hours. An applicable saponification process can be a known process such as a batch process and a continuous process.

Examples of a washing liquid include methanol, acetone, methyl acetate, ethyl acetate, hexane and water. Among these, methanol, methyl acetate and water alone or in combination are preferable. In general, the amount of the washing liquid is preferably 30 to 10000 parts by mass, more preferably 50 to 3000 parts by mass based on 100 parts by mass of a PVA. A washing temperature is preferably 5 to 80° C., more preferably 20 to 70° C. A washing time is preferably 20 min to 10 hours, more preferably 1 hour to 6 hours. An applicable washing process is a known process such as a batch process and a countercurrent washing process.

A base paper used for producing a composite paper of the present invention essentially has an air permeability resistance in accordance with JIS P8117 of 1000 sec or less, and a bulk density (density) in accordance with JIS P8118 of 0.5 to 1.0 g/cm$^3$. For a base paper with an air permeability resistance of 1000 sec or less and a bulk density of 0.5 to 1.0 g/cm$^3$, even when an existing non-fluorine oil-resistant layer is formed, oil resistance cannot be achieved when an intended hot and oily food is wrapped and water resistance cannot be achieved when a hot and wet food is wrapped, but the objective can be achieved by forming an oil-resistant layer comprising the vinyl alcohol polymer (A) on at least one side to 0.1 to 10.0 g/m$^2$.

A coating amount of the oil-resistant layer comprising the vinyl alcohol polymer (A) in the composite paper of the present invention is essentially 0.1 to 10.0 g/m$^2$ on at least one surface of the base paper in terms of dry mass. The coating amount of the oil-resistant layer is more preferably 0.3 to 8.0 g/m$^2$, further preferably 0.5 to 6.0 g/m$^2$, particularly preferably 0.8 to 5.0 g/m$^2$. If the coating amount is less than 0.1 g/m$^2$, oil resistance is insufficient. If the coating amount is more than 10.0 g/m$^2$, a coating liquid concentration required is increased, so that coating suitability may be deteriorated. Furthermore, a composite paper obtained may exhibit lower water vapor permeability.

The paper substrate for the composite paper of the present invention can be appropriately selected, depending on an application. Examples include a craft paper, a high-quality paper, a paper board, a coated paper, a card board, a liner, a glassine paper and a parchment paper. A fibrous raw material for a paper substrate is not limited to cellulose or a cellulose derivative. In place of a paper substrate, fabrics, unwoven fabrics and the like which are made of a material other than cellulose or a cellulose derivative can be used as a substrate.

A water vapor transmission rate of a composite paper of the present invention in accordance with JIS Z0208 is preferably 1000 g/m$^2$·24 hr or more, further preferably 1,500 g/m$^2$·24 hr or more, particularly preferably 2,000 g/m$^2$·24 hr. If a water vapor transmission rate is less than 1000 g/m$^2$·24 hr, a freshly-fried food in a bag of the greaseproof paper causes dew condensation in the bag, so that a batter coating absorbs moisture to be excessively softened, leading to significant deterioration of palate.

A composite paper of the present invention can contain both a vinyl alcohol polymer (A) and a fluorine compound (B) in an oil-resistant layer. The coating amount of the fluorine compound (B) is 1 to 50 parts by mass, preferably 2 to 45 parts by mass, more preferably 3 to 40 parts by mass, most preferably 5 to 35 parts by mass based on 100 parts by mass of the vinyl alcohol polymer (A). If the coating amount of the fluorine compound (B) is less than 1 part by mass, oil resistance may be insufficient. If the coating amount of the fluorine compound (B) is more than 50 parts by mass, its mixability with the vinyl alcohol polymer (A) may be deteriorated.

Combination of the vinyl alcohol polymer (A) with the fluorine compound (B) allows for significant reduction of the coating amount applied on a base paper for achieving a desired performance. In this case, the coating amount applied on the base paper is preferably 0.1 to 3.0 g/m$^2$, more preferably 0.2 to 2.5 g/m$^2$, further preferably 0.3 to 2.0 g/m$^2$, particularly preferably 0.5 to 1.5 g/m$^2$ on at least one surface of the base paper in terms of dry mass. If the coating amount is less than 0.1 g/m$^2$, oil resistance obtained may be insufficient. If the coating amount is more than 3.0 g/m$^2$, the expensive fluorine compound may be uneconomically wasted.

A fluorine compound (B) which is suitably used can be a fluorine compound which is generally used for paper coating. Examples of a fluorine compound which is generally used for paper coating include, but not limited to, polymers containing monomer units of a polyfluoroalkyl-containing acrylate or methacrylate, polymers containing fluoropolyoxyalkylene chains, phosphates having polyfluoroalkyl groups and carboxylates having polyfluoroalkyl groups.

In a composite paper of the present invention, an oil-resistant layer can contain both a vinyl alcohol polymer (A) and a layered inorganic compound (C).

A layered inorganic compound (C) used in the present invention denotes a compound having a structure in which layers in each of which atoms are strongly bonded mutually via, for example, covalent bonding and tightly arranged, are substantially parallel-laminated via a weak force such as van der Waals' force and electrostatic force.

Examples of such a layered inorganic compound (C) include, but not limited to, clay minerals including smectites and vermiculites such as talc, kaolinite, montmorillonite, beidellite, nontronite, saponite, hectorite, sauconite and stevensite; water-swellable fluorine mica minerals such as Na-tetrasilicic fluormica, Na-taeniolite, Li-taeniolite and Na-hectorite; and synthetic mica.

In the present invention, the layered inorganic compound (C) is preferably kaolinite and talc, particularly preferably kaolinite and talc in the light of handling. Furthermore, montmorillonite and smectites which are swellable clay minerals, can be preferably used for providing high oil resistance.

An average particle size of a layered inorganic compound (C) is preferably, but not limited to, 0.01 to 10 μm, more preferably 0.1 to 5 μm, particularly preferably 0.1 to 4 μm. If the average particle size is less than 0.01 μm, viscosity tends to rapidly increase during preparing a coating liquid and coating suitability is deteriorated. If the average particle size is more than 10 μm, a layered inorganic compound tends to precipitate after preparing a coating liquid, leading to uneven coating. An average particle size is determined in the following manner. First, a layered inorganic compound is diluted with ion-exchanged water to 0.05% by mass, and particle size distribution of the diluted solution is measured using a laser-diffraction type particle-size distribution measuring device. An average of the particle size distribution is calculated, and where is defined as an average particle size. A refraction index of the layered inorganic compound is assumed to be 1.6.

Such a layered inorganic compound (C) preferably has an average aspect ratio [(average particle size/(average thickness)] of 20 to 1000, more preferably 30 to 500, particularly preferably 50 to 500. An average aspect ratio is determined in the following manner. First, a layered inorganic compound is diluted with ion-exchanged water to 0.05% by mass. The diluted solution is applied on a corona-treated PET film to form a layered inorganic compound film with a thickness of 5 to 30 μm, which is observed for the status of dispersed particles by an electron microscope to determine a layer thickness and a long diameter of the dispersed particles. An average aspect ratio is determined as an average of long diameter/layer thickness ratios for 100 layered inorganic compound molecules.

In addition to those mentioned above, a layered inorganic compound (C) which can be used in the present invention can be a synthetic material obtained by chemical treatment such as processed products of the above layered inorganic compound which is surface-treated with a silane coupling agent, a synthetic mica and a synthetic smectite, which can be herein used alone or in combination of two or more.

The amount of the layered inorganic compound (C) is preferably 10 to 200 parts by mass, more preferably 20 to 150 parts by mass, further preferably 20 to 120 parts by mass, particularly preferably 20 to 100 parts by mass based on 100 parts by mass of the vinyl alcohol polymer (A). If the amount of the layered inorganic compound (C) is less than 10 parts by mass, water resistance becomes insufficient. If the amount of the layered inorganic compound (C) is more than 200 parts by mass, oil resistance becomes insufficient.

There are no particular restrictions to a method of mixing the vinyl alcohol polymer (A) with the layered inorganic compound (C), but since these are applied on a base substrate as an aqueous coating liquid, it is preferable that (A)

and (B) are mixed in water to prepare an aqueous coating liquid, which is then applied and dried for removing the solvent thereafter.

There are no particular restrictions to a process for preparing such an aqueous coating liquid containing the resin composition of the present invention, but it can be prepared, for example, by (I) mixing an aqueous solution of the PVA (A) with an aqueous dispersion in which the layered inorganic compound (C) has been preliminarily dispersed, (II) adding the layered inorganic compound (C) to an aqueous solution of the PVA (A) and dispersing it, or (III) adding the PVA (A) in an aqueous dispersion in which the layered inorganic compound (C) has been preliminarily dispersed followed by being dissolved by heating. Here, for dispersing the layered inorganic compound (C) in water, a known stirrer or dispersing apparatus can be used.

A concentration of such a coating liquid is, but not limited to, preferably 4 to 30% by mass, more preferably 4 to 25% by mass, particularly preferably 5 to 20% by mass as a solid concentration. If the solid concentration is less than 4% by mass, a thickness of the oil-resistant layer may be insufficient to achieve satisfactory oil resistance. If the solid concentration is more than 30% by mass, viscosity of the coating liquid becomes so high that disadvantageously, coating suitability is deteriorated or an even coating layer cannot be obtained.

The coating liquid of the present invention can be combined with a solvent other than water for adjusting affinity for a base substrate or volatility or the like, as long as the objectives of the present invention are not hampered. Examples of such a solvent can include primary alcohols such as methyl alcohol, ethyl alcohol, n-propyl alcohol, isopropyl alcohol and butyl alcohol; polyols such as ethyleneglycol, propyleneglycol and glycelol; phenols such as phenol and cresols; amines such as ethylenediamine and trimethylenediamine; dimethylsulfoxide; dimethylacetamide; and N-methylpyrrolidone.

A composite paper of the present invention can contain a fatty acid sizing agent (D) in an oil-resistant layer for achieving higher oil resistance. A content of the fatty acid sizing agent (D) is preferably 50 parts by mass or less, more preferably 30 parts by mass or less, further preferably 20 parts by mass or less, particularly preferably 15 parts by mass or less based on 100 parts by mass of the vinyl alcohol polymer (A). If the content of the fatty acid sizing agent is more than 50 parts by mass, oil resistance and/or water resistance may be deteriorated probably because formation of a PVA film may be inhibited.

A fatty acid sizing agent (D) contained in the composite paper of the present invention can be essentially any material containing a fatty acid component including modified fatty acids and salts of a fatty acid. For example, fatty acid amides derived from a fatty acid, fatty acid esters obtained from a fatty acid and an alcohol, and the like can be suitably used. The fatty acid can be any of saturated fatty acids, unsaturated fatty acids, distilled fatty acids, hardened fatty acids and the like. These fatty acids are preferably emulsified or saponified to be coatable. However, if it is coatable by, for example, melting it by heating before coating, it does not necessarily have to be emulsified or saponified. Both vegetable fatty acids and animal fatty acids can be used.

Fatty acids which are modified to be cationized have been conventionally used as a fatty acid sizing agent for paper. A fatty acid sizing agent can be a fatty acid, fatty acid salt or fatty acid modified for providing functionality to which a cationic fixing agent is added or which is epoxidized by an epichlorohydrin agent. Any sizing agent utilizing such a fatty acid can be preferably used as a fatty acid in the present invention.

A composite paper of the present invention can contain a cross-linking agent (E) in a coating layer for achieving higher water resistance. A content of the cross-linking agent (E) is preferably 30 parts by mass or less, more preferably 25 parts by mass or less, further preferably 20 parts by mass or less, particularly preferably 15 parts by mass or less, based on 100 parts by mass of the vinyl alcohol polymer (A). If the content of the cross-linking agent is more than 30 parts by mass, water resistance may be unexpectedly deteriorated probably due to inhibition of crystallinity of a PVA. Meanwhile, a content of the cross-linking agent (E) is preferably 1 part by mass or more. If the content of the cross-linking agent is less than 1 part by mass, water resistance may become insufficient.

There are no particular restrictions to a cross-linking agent (E) contained in a composite paper of the present invention as long as it improves water resistance of a PVA, and glyoxal, urea resins, melamine resins, multivalent metal salts, polyisocyanates and polyamide epichlorohydrin compounds (for example, Ashland Inc., Polycup 172) can be used. In the light of safety, economy and reactivity, zirconium oxynitrate and polyamide epichlorohydrin compounds are particularly preferable.

An oil-resistant layer in a composite paper of the present invention can contain, as necessary, a variety of additives including a plasticizer such as glycols and glycerol; a pH adjuster such as ammonia, sodium hydroxide, sodium carbonate and phosphoric acid; a defoamer; a mold release; and a surfactant. An oil-resistant layer in a composite paper of the present invention can contain a water-soluble polymer such as a vinyl alcohol polymer, a modified vinyl alcohol polymer, a vinyl alcohol-vinyl ester copolymer, a polyacrylamide, a polyacrylic acid, carboxymethylcellulose, hydroxyethylcellulose, hydroxymethylpropylcellulose, casein and starches (oxidized starches); and a synthetic resin emulsion such as a styrene-butadiene copolymer latex, a polyacrylate emulsion, a polymethacrylate emulsion, a vinyl acetate-ethylene copolymer emulsion and a vinyl acetate-acrylate copolymer emulsion, as long as it does not inhibit the effects of the present invention.

An oil-resistant layer can be formed on a paper substrate generally by a known method such as coating one or both sides of the paper with a solution or dispersion using an apparatus such as a size press, a gate roll coater and a bar coater. Drying of a coated paper and crosslinking of a vinyl alcohol polymer (A) with a cross-linking agent (E) added as required can be conducted by, for example, hot air, infrared ray, a heating cylinder and a combination thereof. The dried coated paper can be humidity-conditioned and calendered to further improve barrier properties. The conditions of calendering are preferably a roll temperature of ordinary temperature to 100° C. and a roll linear pressure of 20 to 300 kg/cm.

EXAMPLES

The present invention will be detailed with reference to Examples, but the present invention is not limited to these examples. In Examples and Comparative Examples below, unless otherwise indicated, parts and % are parts by mass and % by mass, respectively.

[Evaluation of a Composite Paper]

(1) Evaluation of Oil Resistance

Kit Test

Oil resistance is generally determined by TAPPI UM557 "Repellency of Paper and Board to Grease, Oil, and Waxes (Kit Test)".

Oil resistance is usually evaluated by a kit test (TAPPI UM557). A kit test is a technique in which a processed paper is put in a hydrocarbon or is contacted with a hydrocarbon mixture with gradually reducing surface tension (castor oil, a mixture of toluene and heptane in various rates) for 15 sec to evaluate resistance against permeation.

Since a kit test can give an index in a very short time, it has been extensively used as a convenient means for evaluating oil resistance, but evaluation obtained from this test may not be a reflection of reality. For example, when, for a given fat, good oil resistance is indicated by a kit test using a fat mixture at a temperature higher than room temperature, actual oil resistance may not be practically acceptable. We, therefore, performed a series of practically usable performance tests described below.

(2) Practical Oil Resistance Evaluation

Resistance Test for a Fatty Acid Mixture

As a fatty acid mixture, five mixtures (A*), (B*), (C*), (D*) and (E*) having the compositions shown in Table 1 are prepared from pure compounds.

TABLE 1

| | Mixture (A*) (% by mass) | Mixture (B*) (% by mass) | Mixture (C*) (% by mass) | Mixture (D*) (% by mass) | Mixture (E*) (% by mass) |
|---|---|---|---|---|---|
| Castor oil | 80 | — | — | — | — |
| Oleic acid C18 | 20 | 75 | 62 | 41 | 9 |
| Linolenic acid C18 | — | 11 | 4 | 3 | 2 |
| Palmitic acid C16 | — | 14 | 32 | 38 | 18 |
| Lauric acid C12 | — | — | 2 | 8 | 56 |
| Capric acid C10 | — | — | — | 3 | 6 |
| Caprylic acid C8 | — | — | — | 1 | 8 |
| Caproic acid C6 | — | — | — | 6 | 1 |

The above mixture generates a waxy solid having various melting points at room temperature. In order to make a composition and a temperature of each mixture even, it is stored at 60° C. at least for 30 min.

Next, a composite paper prepared in an Example or Comparative Example is cut into a size of 5 cm×5 cm, and each test piece is put on a black paper and placed in an oven at 60° C. Then, five drops of the test mixture are dropped onto the oil-resistant layer side of the test piece. The door of the dryer is closed and the test piece is kept in contact with drops of the test mixture for 10 min. Then, the door of the dryer is opened and mixture drops are removed using a blotting paper. Each test mixture is judged to be positive when permeation is not observed while being judged to be negative when permeation is observed from darkening of the droplet-applied area in each surface. For each mixture, at least two test pieces are used for evaluation. The test result is recorded as a code of the test mixture before the first test mixture which permeates the test piece although, when permeation is observed for a fatty acid mixture of composition (A*), it is judged to be negative.

The above test shows that permeability of a hot fatty acid within a temperature range of 40 to 60° C. depends on its chemical structure. For example, heat permeability of a linear fatty acid on a paper sized with an oil-repellent material depends primarily on a length of a hydrocarbon chain, that is, the carbon number of the fatty acid. If the carbon number is low, a time required is reduced and droplets of the fatty acid permeate into a sized paper at a certain temperature. Furthermore, with the same carbon number, it can be found that permeability in a sized paper is substantially unsusceptible to the presence of unsaturation in the structure of a linear fatty acid in comparison with a corresponding saturated fatty acid.

Mixture (A*) contains 20% fatty acid and is diluted with 80% castor oil. (A*) is less permeable and thus generally used for determining the lower performance value required generally for a fast food, for example, the performance value required for producing a disposable paper for a hamburger. A general sized paper as described above usually has a test kit value of 3 to 5. Compositions of mixtures (B*), (C*), (D*) and (E*) represent fatty acid compositions of olive oil, an animal oil, butter and coconut oil, respectively. Since this test utilizes a fatty acid being present in triglycerines contained in a common fat, oil-resistance behavior of a paper under more practical conditions can be evaluated.

Regarding oil resistance when a hot food is packaged, a test for resistance to oleic acid or hot corn oil described below, was performed. A test for resistance to oleic acid is very meaningful in examining the presence of high oil-repellency under practical conditions, because oleic acid is the most prevailing fatty acid among those constituting animal or vegetable oils.

Test for Resistance to Oleic Acid

A composite paper prepared in an Example or Comparative Example is cut into a square of 10 cm×10 cm, and placed in an oven at 60° C. Then, twenty drops of oleic acid are dropped onto the oil-resistant layer side of the composite paper. The test piece thus prepared is left in the oven at 60° C. for 2 hours. Then, oleic-acid droplets are removed using a blotting paper and the sample is placed on a black paper. When oleic acid permeates the paper, the permeated area is observed as a black spot. In this test, when permeation is not observed in any area where oleic acid is added dropwise, the test is judged to be "positive" (that is, resistance to oleic acid is demonstrated). In contrast, when permeation is observed, the test is judged to be negative (that is, resistance to oleic acid is not demonstrated).

Hot Corn Oil Test

This test is a technique used for evaluating a wrapping paper for a fast food. A composite paper prepared in an Example or Comparative Example is cut into a size of 5 cm×5 cm, and each test piece is placed on a black paper and then 1 mL of corn oil is added dropwise onto the oil-resistant layer side of the test piece. The time of addition is regarded as a test initiation time, the test piece is placed in an oven at 110° C. for 20 min and at certain intervals, whether the oil is absorbed or not is observed. When oil absorption occurs, the paper becomes transparent and an absorption degree is indicated by blackening of the test piece. When absorption is observed in 20 min, the test is judged to be negative while when absorption is not observed after 20 min, the test is judged to be positive.

(3) Air Permeation Resistance

It was determined using an Oken type smoothness and air permeability tester in accordance with JIS P8117. An air permeation resistance value is a time taken for passing of 100 mL of air through a certain area. Thus, the larger an air permeation resistance value is, the less air permeates.

(4) Water Vapor Permeability

In accordance with test methods for determination of the water vapor transmission rate of moisture-proof packaging materials (dish method) as described in JIS Z0208-1976, measurement was conducted under the conditions of a temperature of 40+/−0.5° C. and a relative humidity of 90+/−2%. A water vapor transmission rate of 1000 to 5000 g/m$^2$·24 hr is judged as suitable to food packaging without dew condensation in the package or moisture absorption from the outside of the package.

(5) Evaluation of Practical Water Resistance

On the coated side of a composite paper prepared in an Example or Comparative Example was placed one steamed meat bun ("Tenshinkaku-Hojun nikuman" from Nippon Ham), which was then cooked using a microwave by heating at 600 W for one min. One minute later, the composite paper and the steamed meat bun were taken out from the microwave. The steamed meat bun was removed from the composite paper, and the surface of the composite paper was visually observed. Detachability of the food was judged in accordance with the following criteria. Here, evaluation rate A or B can be said to be practically suitable.

A: No adhesion of a croute of steamed meat bun

B: Some adhesion of a thin croute of steamed meat bun

C: Adhesion of a large croute of steamed meat bun

D: Peeling of the bottom of a steamed meat bun and adhesion of a croute and contents (6) Water-resistant Surface Strength On the oil-resistant layer side of a composite paper prepared in an Example or Comparative Example was added dropwise about 0.1 mL of ion-exchanged water at 20° C., which was then rubbed with the tip of a finger. Elution of the coating material was observed and rated on a scale of one to five below.

5: Water resistance is excellent without sliminess.

4: Sliminess is present, but no changes are observed in the coating layer.

3: Some of the coating material is emulsified.

2: The coating material is totally re-emulsified.

1: The coating material is dissolved.

[Synthesis of Vinyl Alcohol Polymer PVA-1]

In a 250 liter pressurized reaction vessel equipped with a stirrer, a nitrogen inlet, an ethylene inlet, an initiator input port and a delay solution input port were charged 107.2 kg of vinyl acetate, 42.8 kg of methanol and 15.6 g of maleic anhydride, and the mixture was warmed to 60° C., and the system was nitrogen-substituted by nitrogen bubbling for 30 min. Then, ethylene was introduced to a reaction vessel pressure of 5.9 Kg/cm$^2$. An initiator, 2,2'-azobis(4-methoxy-2,4-dimethylvaleronitrile)(AMV) was dissolved in methanol to prepare a 2.8 g/L solution, which was then bubbled with nitrogen gas for nitrogen substitution. Separately, maleic anhydride was dissolved in methanol to prepare a 5% solution as a delay solution, which was then bubbled with nitrogen gas for nitrogen substitution. After adjusting an inner temperature of the polymerization vessel to 60° C., 204 mL of the above initiator solution was injected to initiate polymerization. During the polymerization, ethylene was introduced to keep a reaction vessel pressure at 5.9 kg/cm$^2$ and a polymerization temperature at 60° C. The polymerization was conducted while AMV using the above initiator solution at 640 mL/hr and maleic anhydride using the above delay solution were continuously added such that a ratio of vinyl acetate to maleic anhydride is kept constant. After 4 hours when a rate of polymerization reached 30%, the mixture was cooled to quench the polymerization. At this point, the total amount of the maleic anhydride delay solution added by delay was 1400 mL. The reaction vessel was opened to remove ethylene and nitrogen gas was bubbled for completely removing ethylene. Then, the unreacted vinyl acetate monomer was removed under a reduced pressure to give a solution of polyvinyl acetate in methanol. To the obtained polyvinyl acetate solution was added methanol to adjust a concentration to 30° A). To 333 g of the solution of polyvinyl acetate in methanol (100 g of polyvinyl acetate in the solution) was added 46.5 g (a molar ratio [MR] based on vinyl acetate units in polyvinyl acetate: 0.05) of an alkali solution (a 10° A) solution of NaOH in methanol) for saponification. One minute after adding the alkali, the gelated system was pulverized by a pulverizer, and left at 40° C. for one hour to promote saponification. Then, 1000 g of methyl acetate was added to neutralize the residual alkali. After confirming completion of neutralization using a phenolphthalein indicator, to the PVA as a white solid obtained by filtration was added 1000 g of methanol, and the mixture was left at room temperature for 3 hours for washing. After repeating the above washing operation three times, the PVA obtained by centrifugal deliquoring was left in an oven at 70° C. for 2 days to give a dry PVA (PVA-1).

[Analysis of Vinyl Alcohol Polymer PVA-1]

For the vinyl alcohol polymer having carboxyl groups or lactone rings obtained, a saponification degree was 98.5 mol %. Furthermore, the solution of the polyvinyl acetate in methanol was obtained by removing the unreacted vinyl acetate monomers after polymerization. Then, as reprecipitation purification, the solution was mixed with n-hexane to perform precipitation and the precipitate was dissolved in acetone. After repeating the reprecipitation purification three times, it was dried under a reduced pressure at 80° C. for 3 days to give a pure polyvinyl acetate. The polyvinyl acetate was dissolved in DMSO-$D_6$, and was analyzed using 500 MHz proton NMR (JEOL Ltd.; GX-500) at 80° C. Thus, a content of ethylene units was 7 mol %. After the solution of the polyvinyl acetate in methanol was saponified with an alkaline molar ratio of 0.5, the product was pulverized, left at 60° C. for 5 hours for completing saponification and then extracted by methanol soxhlet for 3 days and then dried under a reduced pressure at 80° C. for 3 days to give a purified ethylene-modified PVA having carboxyl groups or lactone rings. An average polymerization degree of the PVA was 1000 as determined as usual in accordance with JIS K6726. For the purified PVA, a content of carboxyl groups or lactone rings, a content of 1,2-glycol bonds and a content of hydroxyl groups in chains of three consecutive hydroxyls were 0.246 mol %, 1.61 mol % and 87%, respectively, as determined by a 500 MHz proton NMR apparatus (JEOL Ltd.; GX-500). Furthermore, a 5% aqueous solution of the purified modified PVA was prepared and used for forming a cast film to a thickness of 10 μm. The film was dried under a reduced pressure at 80° for one day and then a melting point of the PVA was 210° C. as measured using DSC (Mettler Inc., TA3000) in accordance with the method described above.

[Synthesis and Analysis of Vinyl Alcohol Polymers PVA-2 to PVA-9]

PVA-2 to PVA-9 were prepared as described for PVA-1, except that a process for producing a vinyl alcohol polymer was changed as shown in Table 2. The analysis results for the obtained PVAs are shown in Table 3.

TABLE 2

| | Polymerization temperature (° C.) | VAc (kg) | MeOH (kg) | Ethylene pressure during polymerization (kg/cm$^2$) | Delay Type A) | Delay Charge (g) | Delay Total amount (ml) | Initiator Type B) | Initiator Charge (g) | Initiator Total amount (ml) | Polymerization time (hr) | Rate of Polymerization (%) | Alkali amount for saponification (MR) |
|---|---|---|---|---|---|---|---|---|---|---|---|---|---|
| PVA-1 | 60 | 107.2 | 42.8 | 5.9 | MAn | 15.6 | 1,400 | AMV | 204 | 640 | 4 | 30 | 0.05 |
| PVA-2 | 60 | 107.2 | 42.8 | 5.9 | — | — | — | AMV | 200 | 600 | 3.5 | 35 | 0.05 |
| PVA-3 | 60 | 107.2 | 42.8 | 5.9 | IA | 60 | 15,000 | AMV | 300 | 800 | 3.5 | 30 | 0.05 |
| PVA-4 | 60 | 119.8 | 30.1 | 4.7 | — | — | — | AMV | 116 | 360 | 4 | 25 | 0.1 |
| PVA-5 | Identical to PVA-4 | | | | | | | | | | | | 0.02 |
| PVA-6 | 60 | 76.6 | 73.3 | 6.5 | — | — | — | AMV | 175 | 552 | 3 | 20 | 0.1 |
| PVA-7 | 60 | 106.1 | 43.9 | 1.4 | — | — | — | AMV | 53 | 168 | 4 | 20 | 0.05 |
| PVA-8 | 60 | 78.3 | 71.7 | 5.7 | MAn | 5.3 | 837 | AMV | 255 | 804 | 10 | 60 | 0.05 |
| PVA-9 | 60 | 123 | 26.9 | 2.6 | 3MPA | 2.3 | 1581 | AMV | 355 | 1118 | 7 | 50 | 0.05 |

A) MAn; Maleic anhydride
IA; Itaconic acid
3MPA; 3-Mercaptopropionic acid
B) AMV; 2,2'-Azobis(4-methoxy-2,4-dimethylvaleronitrile)

TABLE 3

| PVA | Content of modified ethylene (mol %) | Polymerization degree | Saponification degree (mol %) | Carboxylic acid + lactone (mol %) | Melting point (° C.) | Content of 1,2-glycol bonds (mol %) | Molar fraction of central OH groups in chains of three consecutive hydroxyls (mol %) |
|---|---|---|---|---|---|---|---|
| PVA-1 | 7 | 1000 | 98.5 | 0.246 | 210 | 1.61 | 87 |
| PVA-2 | 7 | 1000 | 98.5 | 0.035 | 213 | 1.61 | 89 |
| PVA-3 | 7 | 1000 | 98.5 | 2.550 | 200 | 1.40 | 80 |
| PVA-4 | 5 | 1500 | 99.5 | 0.041 | 224 | 1.66 | 90 |
| PVA-5 | 5 | 1500 | 96.5 | 0.041 | 190 | 1.50 | 76 |
| PVA-6 | 10 | 500 | 99.0 | 0.054 | 211 | 1.53 | 84 |
| PVA-7 | 3 | 1500 | 98.5 | 0.031 | 230 | 1.73 | 95 |
| PVA-8 | 10 | 400 | 96 | 0.166 | 189 | 1.28 | 79 |
| PVA-9 | 3 | 500 | 97 | 0.277 | 207 | 1.66 | 88 |

[Synthesis and Analysis of Vinyl Alcohol Polymers PVA-10 to PVA-22]

PVA-10 to PVA-22 were prepared as described for PVA-1, except that a process for producing a vinyl alcohol polymer was changed as shown in Table 4. The analysis results for the obtained PVAs are shown in Table 5.

TABLE 4

| | Polymerization temperature (° C.) | VAc (kg) | MeOH (kg) | Ethylene pressure in polymerization (kg/cm$^2$) | Delay Type A) | Delay Charge (g) | Delay Total amount (ml) | Initiator Type B) | Initiator Charge (g) | Initiator Total amount (ml) | Polymerization time (hr) | Rate of Polymerization (%) | Amount of alkali for saponification (MR) |
|---|---|---|---|---|---|---|---|---|---|---|---|---|---|
| PVA-10 | 60 | 81.9 | 68 | — | MAn | 12.3 | 1375 | AMV | 224 | 705 | 4 | 40 | 0.05 |
| PVA-11 | 60 | 81.9 | 68 | — | MAn | 12.3 | 1375 | AMV | 224 | 705 | 4 | 40 | 0.2 |
| PVA-12 | 60 | 101.7 | 48.3 | 2.0 | — | — | — | AMV | 139 | 438 | 5 | 40 | 0.05 |
| PVA-13 | 60 | 57.5 | 92.5 | — | — | — | — | AMV | 471 | 1484 | 5 | 60 | 0.05 |
| PVA-14 | 60 | 81.9 | 68 | 10.2 | MAn | 12.3 | 1375 | AMV | 500 | 1500 | 4 | 30 | 0.1 |
| PVA-15 | 60 | 107.2 | 42.8 | 5.9 | IA | 120 | 30,000 | AMV | 400 | 900 | 3.5 | 30 | 0.05 |
| PVA-16 | 0 | 22.5 | 127.2 | 0.1 | — | — | — | NPP | 402 | 1446 | 10 | 75 | 0.01 |
| PVA-17 | Identical to PVA-1 | | | | | | | | | | | | 0.015 |
| PVA-18 | Identical to PVA-1 | | | | | | | | | | | | 0.013 |
| PVA-19 | 20 | 23.1 | 126.8 | 0.70 | — | — | — | NPP | 198 | 714 | 12 | 75 | 0.1 |
| PVA-20 | 20 | 55.9 | 93.6 | 5.8 | — | — | — | NPP | 710 | 2559 | 5 | 40 | 0.2 |

TABLE 4-continued

| | Polymerization temperature (° C.) | VAc (kg) | MeOH (kg) | Ethylene pressure in polymerization (kg/cm²) | Delay Type A) | Delay Charge (g) | Delay Total amount (ml) | Initiator Type B) | Initiator Charge (g) | Initiator Total amount (ml) | Polymerization time (hr) | Rate of Polymerization (%) | Amount of alkali for saponification (MR) |
|---|---|---|---|---|---|---|---|---|---|---|---|---|---|
| PVA-21 | 100 | 91.9 | 58.1 | 3.2 | — | — | — | V-40 | 65 | 234 | 5 | 40 | 0.04 |
| PVA-22 | 60 | 81.9 | 68 | 0.99 | MAn | 12.3 | 1375 | AMV | 330 | 1200 | 4 | 38 | 0.2 |

A) MAn; Maleic anhydride
IA; Itaconic acid
B) AMV; 2,2'-Azobis(4-methoxy-2,4-dimethylvaleronitrile)
NPP; n-Propyl peroxydicarbonate/N,N-dimethylaniline = 1/1
V-40; 1,1'-Azobis(cyclohexane-1-carbonitrile)

TABLE 5

| PVA | Content of modified ethylene (mol %) | Polymerization degree | Saponification degree (mol %) | Carboxylic acid + lactone (mol %) | Melting point (° C.) | Content of 1,2-glycol bonds (mol %) | Molar fraction of central OH groups in chains of three consecutive hydroxyls (mol %) |
|---|---|---|---|---|---|---|---|
| PVA-10 | 0 | 1000 | 98.5 | 0.247 | 224 | 1.78 | 98 |
| PVA-11 | 0 | 1000 | 99.9 | 0.247 | 235 | 1.8 | 99 |
| PVA-12 | 1 | 1500 | 98.5 | 0.04 | 230 | 1.75 | 94 |
| PVA-13 | 0 | 500 | 99 | 0.048 | 228 | 1.78 | 99 |
| PVA-14 | 15 | 1000 | 98.5 | 0.250 | 190 | 1.40 | 75 |
| PVA-15 | 7 | 1000 | 98.5 | 5.000 | 178 | 1.28 | 74 |
| PVA-16 | 3 | 500 | 97.0 | 0.016 | 205 | 1.69 | 89 |
| PVA-17 | 7 | 1000 | 93.0 | 0.246 | 175 | 1.45 | 77 |
| PVA-18 | 7 | 1000 | 90.0 | 0.246 | 170 | 1.30 | 70 |
| PVA-19 | 5 | 210 | 99 | 0.025 | 223 | 1.49 | 91 |
| PVA-20 | 10 | 500 | 99.5 | 0.043 | 207 | 1.02 | 85 |
| PVA-21 | 3 | 500 | 97.0 | 0.071 | 205 | 2.10 | 89 |
| PVA-22 | 2 | 1000 | 99.9 | 0.220 | 231 | 1.75 | 92 |

Example 1

Preparation of A Composite Paper

A 10% aqueous solution of vinyl alcohol polymer PVA-1 was prepared and applied to a base paper with a basis weight of 47 g/m², a bulk density of 0.8 g/m², an air permeability resistance of 200 sec, using a 2-roll type size press for testing (Kumagai Riki Kogyo Co., Ltd.). The application was conducted at 50° C. under the condition of 100 m/min, and then the paper was dried at 110° C. for 1 min to give a coated paper. The amount of the coating liquid in terms of solid was 1.8 g/m² (both sides). The obtained coated paper was humidity-conditioned at 20° C. and 65% RH for 72 hours, to prepare a composite paper.

[Evaluation of a Composite Paper]

For the composite paper thus obtained, oil resistance, practical water resistance, air permeability resistance, water vapor transmission rate and water-resistant surface strength were measured as described above. In the evaluation of oil resistance, a kit value was 9. In the evaluation of practical oil resistance, permeation was not observed until a mixed solution (C*) assuming an animal oil in a test of resistance to a fatty acid mixture. Furthermore, in a test of resistance to oleic acid, permeation was not observed, so that it was judged to be positive, that is, sufficiently high resistance. A test of resistance to a hot corn oil was negative. An air permeability resistance was 100,000 sec or more, a water vapor transmission rate was 2,630 g/m², a water-resistant surface strength was 3, and practical water resistance was rated as D.

Examples 2 to 21

A coated paper was prepared as described in Example 1, except that an oil-resistant layer had a composition as shown in Table 6, and the composite paper was evaluated. The results are shown in Table 6.

As shown in Table 6, a composite paper containing a predetermined range of vinyl alcohol polymer of the present invention shows good results in any evaluation of oil resistance, water vapor permeability, air permeability resistance, practical water resistance, and water-resistant surface strength.

Comparative Examples 1 to 19

A coated paper was prepared as described in Example 1, except that an oil-resistant layer had a composition as shown in Table 7, and the composite paper was evaluated. The results are shown in Table 7.

TABLE 6

| | Composition of an oil-resistant layer | | | | | | | |
|---|---|---|---|---|---|---|---|---|
| | PVA type | PVA amount (parts by weight) | Crosslinking agent type | Crosslinking agent amount (parts by weight) | Fluorine oil-repellent agent E) (parts by weight) | Base paper air permeability resistance (sec) | Base paper bulk density (g/cm$^3$) | Coating amount both sides (g/m$^2$) |
| Example 1 | PVA-1 | 100 | — | — | — | 200 | 0.8 | 1.8 |
| Example 2 | PVA-1 | 100 | Glyoxal A) | 5 | — | 200 | 0.8 | 2.0 |
| Example 3 | PVA-1 | 100 | Polyamide epichlorohydrin B) | 20 | — | 200 | 0.8 | 2.5 |
| Example 4 | PVA-1 | 100 | Zirconium ammonium carbonate C) | 5 | — | 200 | 0.8 | 2.4 |
| Example 5 | PVA-1 | 100 | Zirconium oxynitrate D) | 5 | — | 200 | 0.8 | 2.4 |
| Example 6 | PVA-2 | 100 | — | — | — | 200 | 0.8 | 1.8 |
| Example 7 | PVA-3 | 100 | Polyamide epichlorohydrin B) | 20 | — | 200 | 0.8 | 2.1 |
| Example 8 | PVA-3 | 100 | Zirconium oxynitrate D) | 5 | — | 200 | 0.8 | 2.1 |
| Example 9 | PVA-4 | 100 | — | — | — | 15 | 0.7 | 7.0 |
| Example 10 | PVA-4 | 100 | Polyamide epichlorohydrin B) | 20 | — | 15 | 0.7 | 7.5 |
| Example 11 | PVA-5 | 100 | — | — | — | 15 | 0.7 | 6.0 |
| Example 12 | PVA-5 | 100 | Polyamide epichlorohydrin B) | 20 | — | 15 | 0.7 | 6.2 |
| Example 13 | PVA-5 | 100 | Zirconium oxynitrate D) | 5 | — | 15 | 0.7 | 6.5 |
| Example 14 | PVA-6 | 100 | — | — | — | 700 | 0.8 | 1.5 |
| Example 15 | PVA-7 | 100 | — | — | — | 700 | 0.8 | 1.0 |
| Example 16 | PVA-8 | 100 | — | — | — | 700 | 0.8 | 1.5 |
| Example 17 | PVA-8 | 100 | Polyamide epichlorohydrin B) | 20 | — | 700 | 0.8 | 1.5 |
| Example 18 | PVA-9 | 100 | — | — | — | 700 | 0.8 | 1.6 |
| Example 19 | PVA-1 | 100 | — | — | 10 | 15 | 0.7 | 2.8 |
| Example 20 | PVA-1 | 100 | — | — | 20 | 15 | 0.7 | 1.7 |
| Example 21 | PVA-1 | 100 | Polyamide epichlorohydrin B) | 20 | 10 | 15 | 0.7 | 2.8 |

| | Evaluation of composite paper | | | | | | | |
|---|---|---|---|---|---|---|---|---|
| | Kit value | Fatty acid mixture test | Oleic-acid Resistance | Hot corn oil test | Air-permeation resistance (sec) | Water vapor transmission rate (g/m$^2$) | Practical water-resistance evaluation | Water-resistant surface strength |
| Example 1 | 9 | C* | Positive | Negative | >100,000 | 2,630 | D | 3 |
| Example 2 | 9 | C* | Positive | Negative | >100,000 | 2,500 | D | 3 |
| Example 3 | 12 | D* | Positive | Positive | >100,000 | 2,800 | C | 5 |
| Example 4 | 9 | C* | Positive | Negative | >100,000 | 2,890 | C | 4 |
| Example 5 | 9 | C* | Positive | Negative | >100,000 | 2,740 | B | 5 |
| Example 6 | 9 | C* | Positive | Negative | >100,000 | 2,580 | D | 4 |
| Example 7 | 12 | D* | Positive | Positive | >100,000 | 3,120 | B | 5 |
| Example 8 | 9 | C* | Positive | Negative | >100,000 | 3,320 | B | 5 |
| Example 9 | 7 | C* | Positive | Negative | 990,000 | 1,550 | C | 4 |
| Example 10 | 8 | C* | Positive | Negative | >100,000 | 1,480 | C | 5 |
| Example 11 | 7 | C* | Positive | Negative | >100,000 | 2,070 | D | 3 |
| Example 12 | 8 | C* | Positive | Negative | >100,000 | 1,940 | C | 5 |
| Example 13 | 7 | C* | Positive | Negative | >100,000 | 1,980 | B | 5 |
| Example 14 | 12 | D* | Positive | Positive | >100,000 | 4,000 | C | 4 |
| Example 15 | 12 | D* | Positive | Positive | >100,000 | 4,220 | C | 4 |
| Example 16 | 12 | D* | Positive | Positive | >100,000 | 4,000 | D | 3 |
| Example 17 | 12 | D* | Positive | Positive | >100,000 | 3,850 | B | 5 |
| Example 18 | 12 | C* | Positive | Negative | >100,000 | 4,060 | C | 3 |
| Example 19 | 12 | E* | Positive | Positive | 70 | >5000 | B | 3 |

TABLE 6-continued

| | | | | | | | | |
|---|---|---|---|---|---|---|---|---|
| Example 20 | 10 | E* | Positive | Positive | 40 | >5000 | A | 4 |
| Example 21 | 12 | E* | Positive | Positive | 75 | >5000 | A | 5 |

A) from BASF

B) Polycup 172 from Ashland Inc.

C) Bacote-20 from MEL Chemicals Inc.

D) Zircosole ZN from Daiichi Kigenso Kagaku Kogyo Co., Ltd.

E) PT-5045 from Solvay

TABLE 7

| | Composition of an oil-resistant layer | | | | | | | |
|---|---|---|---|---|---|---|---|---|
| | PVA type | PVA amount (parts by weight) | Crosslinking agent type | Crosslinking agent amount (parts by weight) | Fluorine oil-repellent agent E) (parts by weight) | Base paper air permeability resistance (sec) | Base paper bulk density (g/cm$^3$) | Coating amount both sides (g/m$^2$) |
| Comparative Example 1 | PVA-10 | 100 | — | — | — | 200 | 0.8 | 1.8 |
| Comparative Example 2 | PVA-10 | 100 | Polyamide epichlorohydrin B) | 20 | — | 200 | 0.8 | 2.5 |
| Comparative Example 3 | PVA-11 | 100 | — | — | — | 200 | 0.8 | 2.0 |
| Comparative Example 4 | PVA-12 | 100 | — | — | — | 15 | 0.7 | 7.0 |
| Comparative Example 5 | PVA-12 | 100 | Polyamide epichlorohydrin B) | 20 | — | 15 | 0.7 | 7.5 |
| Comparative Example 6 | PVA-13 | 100 | — | — | — | 700 | 0.8 | 1.0 |
| Comparative Example 7 | PVA-14 | 100 | — | — | — | 200 | 0.8 | cannot be applied on a base paper because PVA-14 is insoluble in water |
| Comparative Example 8 | PVA-15 | 100 | — | — | — | 200 | 0.8 | 2.0 |
| Comparative Example 9 | PVA-15 | 100 | Polyamide epichlorohydrin B) | 20 | — | 200 | 0.8 | 2.4 |
| Comparative Example 10 | PVA-15 | 100 | Zirconium oxynitrate D) | 5 | — | 200 | 0.8 | 2.1 |
| Comparative Example 11 | PVA-16 | 100 | — | — | — | 200 | 0.8 | 2.0 |
| Comparative Example 12 | PVA-17 | 100 | — | — | — | 200 | 0.8 | 2.2 |
| Comparative Example 13 | PVA-18 | 100 | — | — | — | 200 | 0.8 | 2.5 |
| Comparative Example 14 | PVA-19 | 100 | — | — | — | 200 | 0.8 | 2.4 |
| Comparative Example 15 | PVA-20 | 100 | — | — | — | 200 | 0.8 | cannot be applied on a base paper because a filamentous substance precipitates during coating |
| Comparative Example 16 | PVA-21 | 100 | — | — | — | 200 | 0.8 | 2.0 |
| Comparative Example 17 | PVA-22 | 100 | — | — | — | 200 | 0.8 | cannot be applied on a base paper because a filamentous substance precipitates during coating |
| Comparative Example 18 | PVA-1 | 100 | — | — | — | 200 | 0.8 | 11 |
| Comparative Example 19 | PVA-1 | 100 | — | — | — | 200 | 0.8 | 0.08 |

| | Evaluation of composite paper | | | | | | | |
|---|---|---|---|---|---|---|---|---|
| | Kit value | Fatty acid mixture test | Oleic-acid Resistance | Hot corn oil test | Air-permeation resistance (sec) | Water vapor transmission rate (g/m$^2$) | Practical water-resistance evaluation | Water-resistant surface strength |
| Comparative Example 1 | 8 | A* | Negative | Negative | >100,000 | 3,400 | D | 2 |
| Comparative Example 2 | 8 | A* | Negative | Negative | >100,000 | 3,140 | D | 3 |

TABLE 7-continued

| | | | | | | | | |
|---|---|---|---|---|---|---|---|---|
| Comparative Example 3 | 8 | A* | Negative | Negative | >100,000 | 2,980 | D | 2 |
| Comparative Example 4 | 5 | Negative | Negative | Negative | 48,000 | 6,800 | D | 2 |
| Comparative Example 5 | 5 | Negative | Negative | Negative | 52,000 | 6,720 | D | 3 |
| Comparative Example 6 | 5 | Negative | Negative | Negative | 45,000 | 4,500 | D | 2 |
| Comparative Example 7 | cannot be applied on a base paper because PVA-14 is insoluble in water | | | | | | | |
| Comparative Example 8 | 8 | B* | Positive | Negative | >100,000 | 3,540 | D | 1 |
| Comparative Example 9 | 9 | B* | Positive | Negative | >100,000 | 3,310 | D | 2 |
| Comparative Example 10 | 8 | B* | Positive | Negative | >100,000 | 3,280 | D | 2 |
| Comparative Example 11 | 7 | A* | Negative | Negative | >100,000 | 2,530 | D | 3 |
| Comparative Example 12 | 9 | A* | Negative | Negative | >100,000 | 3,310 | D | 1 |
| Comparative Example 13 | 9 | A* | Negative | Negative | >100,000 | 3,670 | D | 1 |
| Comparative Example 14 | 4 | Negative | Negative | Negative | 72,000 | 3,500 | D | 2 |
| Comparative Example 15 | cannot be applied on a base paper because a filamentous substance precipitates during coating | | | | | | | |
| Comparative Example 16 | 7 | A* | Negative | Negative | >100,000 | 3,060 | D | 2 |
| Comparative Example 17 | cannot be applied on a base paper because a filamentous substance precipitates during coating | | | | | | | |
| Comparative Example 18 | 9 | C* | Positive | Negative | >100,000 | <1000 | D | 2 |
| Comparative Example 19 | 1 | Negative | Negative | Negative | 4,300 | >5,000 | D | 3 |

B) Polycup 172 from Ashland Inc.
D) Zircosole ZN from Daiichi Kigenso Kagaku Kogyo Co., Ltd.
E) PT-5045 from Solvay Comparative Examples 1 to 6 show the evaluation results of composite papers containing a vinyl alcohol polymer with an ethylene content of less than 2 mol %. In all cases, resistance to oleic acid (60° C.) or resistance to hot corn oil (110° C.) as an indicator of oil resistance at a high temperature was not observed, and water-resistant surface strength is insufficient without adding a cross-linking agent.

In Comparative Example 7, the use of a vinyl alcohol polymer with an ethylene content of more than 10 mol % was attempted, but a composite paper cannot be produced due to the presence of insoluble components during preparing a coating liquid.

Comparative Examples 8 to 10 show the evaluation results of composite papers with a total content of carboxyl groups and lactone rings of more than 3 mol %. In all cases, water-resistant surface strength is insufficient.

Comparative Example 11 shows the evaluation results of a composite paper containing a vinyl alcohol polymer with a total content of carboxyl groups and lactone rings of less than 0.02 mol %, and resistance to oleic acid or hot corn oil was not observed.

Comparative Examples 12 and 13 show the evaluation results of composite papers containing a vinyl alcohol polymer with a saponification degree of less than 95 mol % and a melting point of lower than 180° C. In both cases, water-resistant surface strength was insufficient.

Comparative Example 14 shows the evaluation results of a composite paper containing a vinyl alcohol polymer with a polymerization degree of less than 300, and its kit value is low, so that resistance to a fatty acid mixture, oleic acid or hot corn oil is not observed. Furthermore, water-resistant surface strength is also insufficient.

In Comparative Example 15, the use of a vinyl alcohol polymer with a content of 1,2-glycol bonds of less than 1.2 mol % was attempted, but a filamentous substance precipitated in the coating liquid, so that a composite paper could not be stably obtained.

Comparative Example 16 shows the evaluation results of a composite paper containing a vinyl alcohol polymer with a content of 1,2-glycol bonds of more than 2.0 mol %, and resistance to oleic acid or hot corn oil is not observed and water-resistant surface strength is insufficient.

In Comparative Example 17, the use of a vinyl alcohol polymer with a saponification degree of more than 99.5 mol % and a melting point of higher than 230° C. was attempted, but a filamentous substance precipitated in the coating liquid, so that a composite paper could not be stably obtained.

Comparative Example 18 shows the evaluation results of a composite paper to which a predetermined range of vinyl alcohol polymer of the present invention is applied in an amount of more than 10.0 g/m$^2$, and water vapor transmission rate is as insufficient as 950 g/m$^2$ and furthermore, water-resistant surface strength is insufficient.

Comparative Example 19 shows the evaluation results of a composite paper to which a predetermined range of vinyl alcohol polymer of the present invention is applied in an amount of less than 0.5 g/m$^2$, and oil resistance is insufficient.

Example 22

Preparation of a Dispersion of a Layered Inorganic Compound

Kaolin-1 ("BARRISURF HX" from Imerys Minerals Japan K. K.; average particle size: 1.5 μm, average aspect ratio: 100) was dispersed in water to a concentration of 40%, which was then processed by a domestic mixer for 10 min, to prepare a dispersion. For determining an average particle size, a dispersion obtained was diluted with ion-exchanged water to 0.05% by mass, and grain size distribution was measured by a laser diffraction particle size analyzer (Shimadzu Corporation: SALD-2200) and an average was calculated as an average particle size.

[Preparation of a Coating Liquid]

A 14% aqueous solution of vinyl alcohol polymer PVA-1 was prepared. The aqueous solution of vinyl alcohol polymer was mixed with the above kaolin dispersion, such that kaolin content became 40 parts based on 100 parts of vinyl alcohol polymer. Then, water was added to the mixture such that a solid concentration became 15% to prepare a coating liquid.

[Preparation of a Composite Paper]

The coating liquid obtained above was applied to a base paper A (a base paper with a basis weight of 70 g/m$^2$, a bulk density of 0.7 g/cm$^3$, and an air permeability resistance of 15 sec), using a 2-roll type size press for testing (Kumagai Riki Kogyo Co., Ltd.). The application was conducted at 50° C. under the condition of 100 m/min, and then the paper was dried at 110° C. for 1 min to give a coated paper. The amount of the coating liquid in terms of solid was 5.8 g/m$^2$ (both sides). The obtained coated paper was humidity-conditioned at 20° C. and 65% RH for 72 hours, to prepare a composite paper.

[Evaluation of a Composite Paper]

For the composite paper thus obtained, oil resistance, practical water resistance, air permeability resistance, water vapor transmission rate and water-resistant surface strength were measured as described above. In the evaluation of oil resistance, a kit value was 8. In the evaluation of practical oil resistance, permeation was not observed until a mixed solution (C*) assuming an animal oil in a test of resistance to a fatty acid. Furthermore, a test of resistance to oleic acid was judged to be positive. In a test of resistance to hot corn oil, permeation was not observed, so that it was judged to be positive, that is, sufficiently high resistance. An air permeability resistance was 80,000 sec, and a water vapor transmission rate was 2,100 g/m$^2$. Furthermore, practical water resistance was rated as A because a croute of a steamed meat bun did not adhere to the coating surface. A water-resistant surface strength was rated as 5.

Examples 22 to 49

Composite papers were prepared and evaluated as described in Example 22, except that a composition of an oil-resistant layer was changed as shown in Table 8. The results are shown in Table 8. Details of the layered inorganic compounds in the table are as follows.

Kaolin-2 ("BARRISURF LX" from Imerys Minerals Japan K. K.: average particle size: 1.5 μm, aspect ratio: 60)

Kaolin-3 ("Eckalite120" from Imerys Minerals Japan K. K.: average particle size: 1.6 μm, aspect ratio: 30)

Kaolin-4 ("Flat DS" from Imerys Minerals Japan K. K.: average particle size: 4 μm, aspect ratio: 8)

Talc ("EX-15" from Yamaguchi Mica Co., Ltd.: average particle size: 15 μm, aspect ratio: 20)

Montmorillonite ("Kunipia" from Kunimine Industries CO., Ltd.: average particle size: 0.1 to 0.5 μm, aspect ratio: 200)

As shown in Table 8, composite papers containing a predetermined range of vinyl alcohol polymer and a particular layered inorganic compound of the present invention exhibited good results in all evaluations of oil resistance, water vapor permeability, air permeability resistance, practical water resistance and water-resistant surface strength.

Comparative Examples 20 to 34

Composite papers were prepared and evaluated as described in Example 22, except that a composition of an oil-resistant layer was changed as shown in Table 9. The results are shown in Table 9.

TABLE 8

| | Composition of an oil-resistant layer | | | | | | | | | |
|---|---|---|---|---|---|---|---|---|---|---|
| | PVA type | PVA amount (parts by weight) | Inorganic compound | Inorganic compound Aspect ratio | Inorganic compound amount (parts by mass) | Additive type | Additive amount (parts by mass) | Base paper air permeability resistance (sec) | Base paper bulk density (g/cm$^3$) | Coating amount both sides (g/m$^2$) |
| Example 22 | PVA-1 | 100 | Kaolin-1 | 100 | 40 | — | — | 15 | 0.7 | 5.8 |
| Example 23 | PVA-1 | 100 | Kaolin-1 | 100 | 10 | — | — | 15 | 0.7 | 6.4 |
| Example 24 | PVA-1 | 100 | Kaolin-1 | 100 | 25 | — | — | 15 | 0.7 | 6.2 |
| Example 25 | PVA-1 | 100 | Kaolin-1 | 100 | 60 | — | — | 15 | 0.7 | 5.5 |
| Example 26 | PVA-1 | 100 | Kaolin-1 | 100 | 180 | — | — | 15 | 0.7 | 3.8 |
| Example 27 | PVA-1 | 100 | Kaolin-1 | 100 | 40 | Fatty acid sizing agent A) | 20 | 15 | 0.7 | 6.0 |
| Example 28 | PVA-1 | 100 | Kaolin-1 | 100 | 40 | Polyamide epichlorohydrin B) | 20 | 15 | 0.7 | 5.8 |
| Example 29 | PVA-1 | 100 | Kaolin-1 | 100 | 40 | Zirconium oxynitrate C) | 5 | 15 | 0.7 | 5.6 |
| Example 30 | PVA-1 | 100 | Kaolin-2 | 60 | 40 | — | — | 200 | 0.8 | 2.1 |
| Example 31 | PVA-1 | 100 | Kaolin-3 | 30 | 40 | — | — | 200 | 0.8 | 2.2 |
| Example 32 | PVA-1 | 100 | Talc | 20 | 40 | — | — | 200 | 0.8 | 1.9 |
| Example 33 | PVA-1 | 100 | Montmorillonite | 200 | 40 | — | — | 200 | 0.8 | 2.4 |
| Example 34 | PVA-2 | 100 | Kaolin-1 | 100 | 40 | — | — | 15 | 0.7 | 5.9 |
| Example 35 | PVA-3 | 100 | Kaolin-1 | 100 | 40 | — | — | 15 | 0.7 | 5.8 |
| Example 36 | PVA-3 | 100 | Kaolin-1 | 100 | 40 | Fatty acid sizing agent A) | 20 | 15 | 0.7 | 6.1 |
| Example 37 | PVA-4 | 100 | Kaolin-1 | 100 | 40 | — | — | 15 | 0.7 | 5.9 |
| Example 38 | PVA-4 | 100 | Kaolin-1 | 100 | 40 | Fatty acid sizing agent A) | 20 | 15 | 0.7 | 6.1 |

TABLE 8-continued

| | | | | | | | | | | |
|---|---|---|---|---|---|---|---|---|---|---|
| Example 39 | PVA-5 | 100 | Kaolin-1 | 100 | 40 | — | — | 15 | 0.7 | 5.9 |
| Example 40 | PVA-5 | 100 | Kaolin-1 | 100 | 40 | Fatty acid sizing agent A) | 20 | 15 | 0.7 | 6.1 |
| Example 41 | PVA-5 | 100 | Kaolin-1 | 100 | 40 | Polyamide epichlorohydrin B) | 20 | 15 | 0.7 | 5.9 |
| Example 42 | PVA-6 | 100 | Kaolin-1 | 100 | 40 | — | — | 700 | 0.8 | 2.1 |
| Example 43 | PVA-7 | 100 | Kaolin-1 | 100 | 40 | — | — | 700 | 0.8 | 1.2 |
| Example 44 | PVA-8 | 100 | Kaolin-1 | 100 | 40 | — | — | 700 | 0.8 | 1.8 |
| Example 45 | PVA-8 | 100 | Kaolin-1 | 100 | 40 | — | — | 700 | 0.8 | 1.8 |
| Example 46 | PVA-9 | 100 | Kaolin-1 | 100 | 40 | — | — | 700 | 0.8 | 2.0 |
| Example 47 | PVA-1 | 100 | Kaolin-1 | 100 | 5 | — | — | 15 | 0.7 | 4.9 |
| Example 48 | PVA-1 | 100 | Kaolin-1 | 100 | 220 | — | — | 15 | 0.7 | 3.4 |
| Example 49 | PVA-1 | 100 | Kaolin-4 | 8 | 40 | — | — | 15 | 0.7 | 5.3 |

| | Evaluation of composite paper | | | | | | | |
|---|---|---|---|---|---|---|---|---|
| | Kit value | Fatty acid mixture test | Oleic-acid Resistance | Hot corn oil test | Air-permeation resistance (sec) | Water vapor transmission rate ($g/m^2$) | Practical water-resistance evaluation | Water-resistant surface strength |
| Example 22 | 8 | C* | Positive | Positive | 80,000 | 2,100 | A | 5 |
| Example 23 | 5 | A* | Positive | Negative | 50,000 | 3,050 | B | 4 |
| Example 24 | 7 | B* | Positive | Negative | 65,000 | 2,800 | B | 5 |
| Example 25 | 8 | C* | Positive | Positive | 82,000 | 1,400 | A | 5 |
| Example 26 | 9 | D* | Positive | Positive | 60,000 | 2,400 | A | 5 |
| Example 27 | 10 | D* | Positive | Positive | 53,000 | >5000 | A | 5 |
| Example 28 | 9 | D* | Positive | Positive | 55,000 | 3,600 | A | 5 |
| Example 29 | 8 | D* | Positive | Positive | 60,000 | 3,400 | A | 5 |
| Example 30 | 10 | D* | Positive | Positive | <100,000 | 1,750 | A | 5 |
| Example 31 | 9 | C* | Positive | Positive | 80,000 | 2,120 | B | 4 |
| Example 32 | 9 | C* | Positive | Positive | 80,000 | 1,890 | B | 4 |
| Example 33 | 10 | D* | Positive | Positive | <100,000 | 1,250 | A | 5 |
| Example 34 | 8 | C* | Positive | Positive | 73,000 | 2,350 | B | 4 |
| Example 35 | 8 | C* | Positive | Positive | 71,000 | 2,400 | A | 5 |
| Example 36 | 11 | E* | Positive | Positive | 64,000 | 4,600 | A | 5 |
| Example 37 | 9 | D* | Positive | Positive | 82,000 | 2,900 | A | 5 |
| Example 38 | 10 | D* | Positive | Positive | 69,000 | >5000 | A | 5 |
| Example 39 | 8 | C* | Positive | Positive | 90,000 | 3,100 | B | 4 |
| Example 40 | 10 | D* | Positive | Positive | 65,000 | >5000 | A | 5 |
| Example 41 | 9 | C* | Positive | Positive | 72,000 | 4,400 | A | 5 |
| Example 42 | 12 | D* | Positive | Positive | 90,000 | 3,700 | A | 5 |
| Example 43 | 12 | E* | Positive | Positive | <100,000 | 2,100 | A | 5 |
| Example 44 | 12 | E* | Positive | Positive | <100,000 | 4,300 | A | 5 |
| Example 45 | 12 | E* | Positive | Positive | <100,000 | 3,900 | A | 5 |
| Example 46 | 12 | E* | Positive | Positive | <100,000 | 3,450 | A | 5 |
| Example 47 | 3 | A* | Positive | Negative | 31,000 | 3,300 | D | 3 |
| Example 48 | 4 | A* | Positive | Negative | 45,000 | 2,900 | B | 4 |
| Example 49 | 2 | A* | Positive | Negative | 30,000 | 3,200 | B | 4 |

A) NS-815 from TOHO Chemical Industry Co., Ltd.

B) Polycup 172 from Ashland Inc..

C) Zircosole ZN from Daiichi Kigenso Kagaku Kogyo Co., Ltd.

TABLE 9

| | Composition of an oil-resistant layer | | | | | | | | | |
|---|---|---|---|---|---|---|---|---|---|---|
| | PVA type | PVA amount (parts by weight) | Inorganic compound | Inorganic compound Aspect ratio | Inorganic compound amount (parts by mass) | Additive type | Additive amount (parts by mass) | Base paper air permeability resistance (sec) | Base paper bulk density ($g/cm^3$) | Coating amount both sides ($g/m^2$) |
| Comparative Example 20 | PVA-10 | 100 | Kaolin-1 | 100 | 40 | — | — | 15 | 0.7 | 6.2 |
| Comparative Example 21 | PVA-11 | 100 | Kaolin-1 | 100 | 40 | — | — | 15 | 0.7 | 6.1 |
| Comparative Example 22 | PVA-12 | 100 | Kaolin-1 | 100 | 40 | — | — | 15 | 0.7 | 6.0 |
| Comparative Example 23 | PVA-13 | 100 | Kaolin-1 | 100 | 40 | — | — | 700 | 0.8 | 2.2 |
| Comparative Example 24 | PVA-14 | 100 | Kaolin-1 | 100 | 40 | — | — | 15 | 0.7 | cannot be applied on a base paper because PVA-14 is insoluble in water |

TABLE 9-continued

| | | | | | | | | | | |
|---|---|---|---|---|---|---|---|---|---|---|
| Comparative Example 25 | PVA-15 | 100 | Kaolin-1 | 100 | 40 | — | — | 15 | 0.7 | 6.1 |
| Comparative Example 26 | PVA-16 | 100 | Kaolin-1 | 100 | 40 | — | — | 700 | 0.8 | 2.0 |
| Comparative Example 27 | PVA-17 | 100 | Kaolin-1 | 100 | 40 | — | — | 200 | 0.8 | 2.4 |
| Comparative Example 28 | PVA-18 | 100 | Kaolin-1 | 100 | 40 | — | — | 200 | 0.8 | 2.6 |
| Comparative Example 29 | PVA-19 | 100 | Kaolin-1 | 100 | 40 | — | — | 200 | 0.8 | 3.7 |
| Comparative Example 30 | PVA-20 | 100 | Kaolin-1 | 100 | 40 | — | — | 200 | 0.8 | cannot be applied on a base paper because a filamentous substance precipitates during coating |
| Comparative Example 31 | PVA-21 | 100 | Kaolin-1 | 100 | 40 | — | — | 200 | 0.8 | 3.6 |
| Comparative Example 32 | PVA-22 | 100 | Kaolin-1 | 100 | 40 | — | — | 200 | 0.8 | cannot be applied on a base paper because a filamentous substance precipitates during coating |
| Comparative Example 33 | PVA-1 | 100 | Kaolin-2 | 30 | 40 | — | — | 200 | 0.8 | 0.08 |
| Comparative Example 34 | PVA-1 | 100 | Kaolin-2 | 30 | 40 | — | — | 200 | 0.8 | 21** |

| | Evaluation of composite paper | | | | | | | |
|---|---|---|---|---|---|---|---|---|
| | Kit value | Fatty acid mixture test | Oleic-acid Resistance | Hot corn oil test | Air-permeation resistance (sec) | Water vapor transmission rate ($g/m^2$) | Practical water-resistance evaluation | Water-resistant surface strength |
| Comparative Example 20 | 5 | A* | Negative | Negative | 3,100 | 4,800 | C | 3 |
| Comparative Example 21 | 5 | A* | Negative | Negative | 2,400 | 4,300 | C | 3 |
| Comparative Example 22 | 5 | A* | Negative | Negative | 3,200 | 4,750 | C | 3 |
| Comparative Example 23 | 6 | A* | Negative | Negative | 3,050 | 4,840 | C | 3 |
| Comparative Example 24 | cannot be applied on a base paper because PVA-14 is insoluble in water | | | | | | | |
| Comparative Example 25 | 8 | B* | Positive | Negative | 63,000 | 2,700 | C | 3 |
| Comparative Example 26 | 6 | A* | Negative | Negative | 51,000 | 3,200 | B | 4 |
| Comparative Example 27 | 6 | A* | Negative | Negative | 65,000 | 2,900 | B | 4 |
| Comparative Example 28 | 6 | A* | Negative | Negative | 72,000 | 2,300 | B | 4 |
| Comparative Example 29 | 5 | A* | Negative | Negative | 54,000 | 4,000 | C | 3 |
| Comparative Example 30 | cannot be applied on a base paper because a filamentous substance precipitates during coating | | | | | | | |
| Comparative Example 31 | 4 | A* | Negative | Negative | 56,000 | 3,850 | C | 3 |
| Comparative Example 32 | cannot be applied on a base paper because a filamentous substance precipitates during coating | | | | | | | |
| Comparative Example 33 | 1 | Negative | Negative | Negative | 3,200 | >5000 | D | 3 |
| Comparative Example 34 | 8 | A* | Negative | Negative | >100,000 | <1000 | B | 4 |

**Uneven coating

Comparative Examples 20 to 23 show the evaluation results of composite papers containing a vinyl alcohol polymer with an ethylene content of less than 2 mol %. In any case, a kit value was 5 to 6, indicating medium oil resistance, but high practical oil resistance at a high temperature was not observed and water resistance was insufficient.

In Comparative Example 24, the use of a vinyl alcohol polymer with an ethylene content of more than 10 mol % was attempted, but a composite paper could not be prepared due to the presence of unsolved components during preparing a coating liquid.

Comparative Example 25 shows the evaluation results of a composite paper containing a vinyl alcohol polymer with a total content of carboxyl groups and lactone rings of more than 3 mol %. Water resistance was insufficient.

Comparative Example 26 shows the evaluation results of a composite paper containing a vinyl alcohol polymer with a total content of carboxyl groups and lactone rings of less than 0.02 mol %, but the layered inorganic compound precipitated due to insufficient dispersibility of the coating liquid, leading to tendency to uneven coating. Thus, resistance to corn oil at a high temperature is not observed.

Comparative Examples 27 and 28 show the evaluation results of composite papers containing a vinyl alcohol polymer with a saponification degree of less than 95 mol % and a melting point of lower than 180° C. In both cases, water resistance is insufficient.

Comparative Example 29 shows the evaluation results of a composite paper containing a vinyl alcohol polymer with a polymerization degree of less than 300, but resistance to a fatty acid mixture at a high temperature is low and resistance to corn oil is not observed. Also, water resistance is insufficient.

In Comparative Example 30, the use of a vinyl alcohol polymer with a content of 1,2-glycol bonds of less than 1.2 mol % was attempted, but a filamentous substance precipitated in the coating liquid and thus a composite paper was not stably produced.

Comparative Example 31 shows the evaluation results of a composite paper containing a vinyl alcohol polymer with a content of 1,2-glycol bonds of more than 2.0 mol %, but resistance to a fatty acid mixture at a high temperature is low, resistance to corn oil is not observed, and water resistance is insufficient.

In Comparative Example 32, the use of a vinyl alcohol polymer with a saponification degree of more than 99.5 mol % and a melting point of higher than 230° C. was attempted, but a filamentous substance precipitated in the coating liquid, and thus a composite paper was not stably produced.

Comparative Example 33 shows the evaluation results of a composite paper to which a predetermined range of vinyl alcohol polymer of the present invention was applied in an amount of less than 0.1 g/m$^2$, and oil resistance is insufficient.

Comparative Example 34 shows the evaluation results of a composite paper to which a predetermined range of vinyl alcohol polymer of the present invention was applied in an amount of 10 g/m$^2$ or more per one side, and resistance to a fatty acid mixture at a high temperature is low and resistance to corn oil is not observed.

INDUSTRIAL USABILITY

A composite paper of the present invention can keep practically acceptable oil resistance even when it wraps a hot and oily food and exhibits excellent water resistance even when it wraps a steamy food, and it is, therefore, useful for providing a practically useful greaseproof paper for a wrapping or package for various fried foods and fat-containing foods.

The invention claimed is:

1. A composite paper, comprising:

an oil-resistant layer, which comprises:

a vinyl alcohol polymer, which has an amount of ethylene units ranging from 2 mol % to 10 mol %, a viscosity-average degree of polymerization ranging from 300 to 2000, a saponification degree ranging from 95 mol % to 99.5 mol %, a total amount of a carboxyl group and a lactone ring ranging from 0.02 mol % to 3.0 mol %, a melting point ranging from 180° C. to 230° C., an amount of a 1,2-glycol bond ranging from 1.2 mol % to 2 mol %, and a molar fraction of a central hydroxyl group in a chain of three consecutive hydroxyls by a triad expression relative to vinyl alcohol units ranging from 65 mol % to 98 mol %, a base paper, which has an air permeability resistance that is less than or equal to 1000 seconds and a bulk density ranging from 0.5 g/cm$^3$ to 1.0 g/cm$^3$ , and wherein the oil resistant layer further comprises a fluorine compound in an amount ranging from 1 part to 50 parts by mass, based on 100 parts by mass of the vinyl alcohol polymer, where the oil-resistant layer is formed in an amount ranging from 0.1 g/m$^2$ to 3.0 g/m$^2$ in terms of dry mass, wherein the oil-resistant layer is formed on a surface of the base paper.

2. The composite paper as claimed in claim 1, which has a water vapor transmission rate that is more than or equal to 1000 g/m$^2$·24 h.

3. The composite paper as claimed in claim 1, wherein the oil-resistant layer further comprises:

a layered inorganic compound in an amount ranging from 10 parts to 200 parts by mass, based on 100 parts by mass of the vinyl alcohol polymer, wherein the layered inorganic compound has an average aspect ratio ranging from 20 to 1000, and the oil-resistant layer is formed in an amount ranging from 0.5 g/m$^2$ to 10.0 g/m$^2$ in terms of dry mass.

4. The composite paper as claimed in claim 3, wherein the layered inorganic compound is kaolin.

5. The composite paper as claimed in claim 3, wherein the layered inorganic compound is talc.

6. The composite paper as claimed in claim 3, wherein the layered inorganic compound is a swelling clay mineral.

7. The composite paper of claim 3, wherein the oil-resistant layer further comprises:

a fatty acid sizing agent in an amount that is less than or equal to 50 parts by mass, based on 100 parts by mass of the vinyl alcohol polymer.

8. The composite paper of claim 1, wherein the oil-resistant layer further comprises:

a cross-linking agent in an amount that is less than or equal to 30 parts by mass, based on 100 parts by mass of the vinyl alcohol polymer.

9. The composite paper as claimed in claim 8, wherein the cross-linking agent is a polyamide epichlorohydrin compound.

10. The composite paper as claimed in claim 8, wherein the cross-linking agent is a zirconium compound.

11. The composite paper as claimed in claim 10, wherein the cross-linking agent is zirconium oxynitrate.

* * * * *